US006556804B1

(12) United States Patent
Löbel et al.

(10) Patent No.: US 6,556,804 B1
(45) Date of Patent: Apr. 29, 2003

(54) PRINTER OR COPIER FOR SIMULTANEOUSLY PRINTING A SUPPORTING MATERIAL ON BOTH SIDES

(75) Inventors: Markus Löbel, Freising (DE); Vilmar Eggerstorfer, Poing (DE); Manfred Viechter, Walpertskirchen (DE); Albrecht Gerstner, Oberbergkirchen (DE); Karl Zappe, Schwindegg (DE)

(73) Assignee: OcéPrinting Systems GmbH, Poing (DE)

( * ) Notice: Subject to any disclaimer, the term of this patent is extended or adjusted under 35 U.S.C. 154(b) by 0 days.

(21) Appl. No.: 09/786,257

(22) PCT Filed: Sep. 3, 1999

(86) PCT No.: PCT/EP99/06487

§ 371 (c)(1),
(2), (4) Date: Apr. 18, 2001

(87) PCT Pub. No.: WO00/14607

PCT Pub. Date: Mar. 16, 2000

(30) Foreign Application Priority Data

Sep. 3, 1998 (DE) ..... 198 40 201

(51) Int. Cl.[7] ..... G03G 15/23; G03G 15/16

(52) U.S. Cl. ..... 399/306; 399/66; 399/82; 399/296

(58) Field of Search ..... 399/306, 297, 399/296, 66, 82, 302

(56) References Cited

U.S. PATENT DOCUMENTS 5,797,077 A * 8/1998 Samizo et al. ..... 399/302 X
5,805,967 A * 9/1998 De Bock et al. ..... 399/306 X
6,246,856 B1 * 6/2001 Kopp et al. ..... 399/306 X

FOREIGN PATENT DOCUMENTS

JP 11-212308 * 8/1999
WO WO 98/39691 * 9/1998

* cited by examiner

*Primary Examiner*—Sophia S. Chen
(74) *Attorney, Agent, or Firm*—Schiff Hardin & Waite

(57) ABSTRACT

A printer or copier operates to print a carrier material on both sides. A transfer station in the printer or copier has two transfer bands which transfer toner images onto the supporting material. A transfer corotron recharges the toner particles to a polarity for transfer to the carrier material at a transfer location. A first transfer mode provides for accumulating a plurality of toner images on the transfer band before transfer to the carrier material. A second transfer mode provides continuous transfer of the toner image to the carrier material.

35 Claims, 24 Drawing Sheets

THE FOLLOWING APPLIES:

$$i = \frac{U}{\Sigma R}$$

WHEREBY i = 0 APPLIES FOR R TRANSMISSION BAND = ∞

AREA A = WIDTH THICKNESS
LENGTH 1 = SPACING OF THE DRUMS $$R = \frac{p * 1}{A}$$

R RESISTANCE
A CROSS SECTIONAL AREA
l SPACING OF THE DRUMS
p SPECIFIC RESISTANCE OF THE MATERIAL

R TRANSFER DRUM
R TRANSFER BAND 1
R TONER OF FRONT SIDE
R PRINT MEDIUM
R TONER OF BACK SIDE
R TRANSFER BAND 2
R COUNTER PRESSURE DRUM

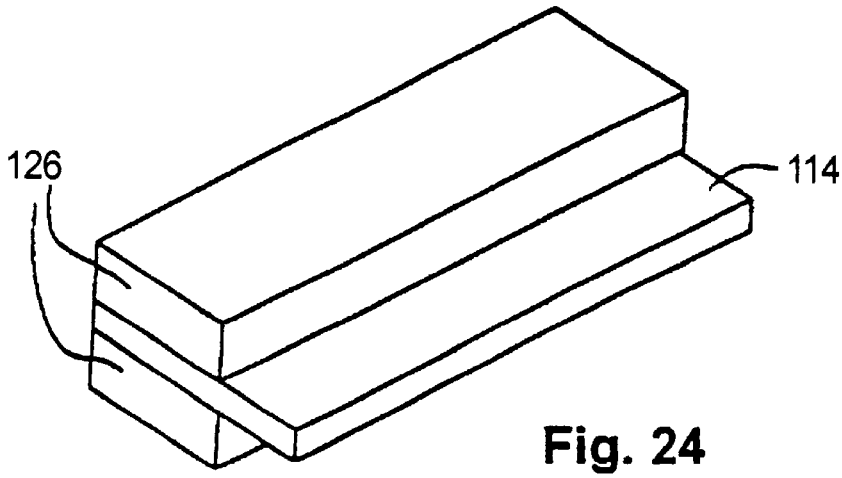
Fig. 24
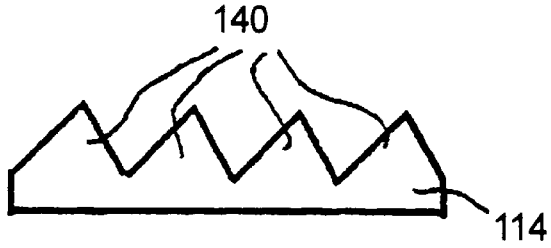
Fig. 25
Fig. 26
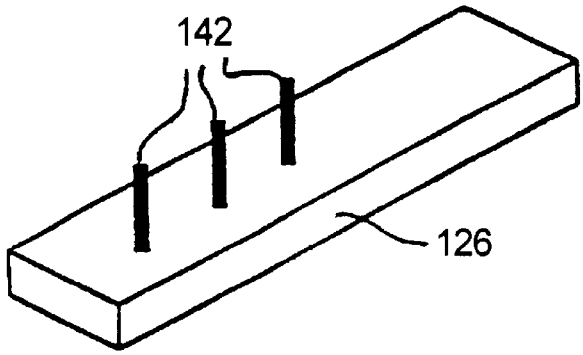

PRINTER OR COPIER FOR SIMULTANEOUSLY PRINTING A SUPPORTING MATERIAL ON BOTH SIDES

BACKGROUND OF THE INVENTION

1. Field of the Invention

The present invention is directed to a printer or copier with a transfer station for simultaneous both-sided printing of a carrier material. The invention is also directed to a corotron device that can be utilized in the transfer station.

2. Description of the Related Art

High-performance printers and high-performance copiers often have the capability of printing the front side and the back side of a carrier material, for example paper. This operating mode is also called duplex printing. It is known to first print one side, for example the front side, with a toner image and to subsequently turn the carrier material over. It is then reconveyed to the same printing station in order to then print the second side, usually the back side, with a second toner image. This type of duplex printing is known both for web-shaped material as well as for a single-sheet carrier material. In such a printing mode, the overall throughput is not high due to the additional transport and the turn-over of the carrier material. Given another known solution, a printer or copier system is given two printing units, whereby each printing unit prints one side of the carrier material. In this case, considerable space for the two printer units is required within the system and the technological outlay is high.

Given a printer device disclosed by U.S. Pat. No. 5,526,107, continuous form paper is supplied to a transfer printing location of a photoconductive cylinder that has electrophotographic units at two surfaces for producing differently colored toner images. At the transfer printing location, the continuous form paper is printed with a first color on the front side; subsequently, the continuous form paper is redirected and is supplied to a printing location at the same photoconductive cylinder lying opposite the transfer printing location and the back side is printed there.

European Patent Document EP-A-0 320 985 discloses that a transfer band is employed, this carrying toner images that have been transferred from a photoconductive drum onto the transfer band. German Patent Document DE-A-197 13 964, which is identical in content with U.S. Pat. No. 5,797,077, discloses a transfer station for simultaneous printing of both sides of a carrier material (duplex printing). The transfer station contains a pivotable transfer printing station that holds a transfer band away from the carrier material in a first position, so that no toner images are transferred onto this carrier material. In this position, toner images are produced superimposed on the transfer band in order to enable a multi-color printing. In a second position, the transfer station is pivoted against the carrier material and transfers the multi-color toner image.

Published PCT application WO 87/02792 discloses a corotron device having a corotron electrode whose cooperating electrode is implemented as a metal plate. This metal plate lies at ground potential. The electrical field generated between the corotron electrode and the cooperating electrode leads to a charge influencing of the toner particles.

SUMMARY OF THE INVENTION

An object of the present invention is to create a printer or copier that enables a simultaneous printing of front side and back side of a carrier material given low outlay and with high printing quality.

This object is achieved by a printer or copier having a transfer station for the simultaneous both-sided printing of a carrier material, whereby a first endless transfer band of a first transfer module carries toner particles of a first polarity in the region of a transfer printing location, a second endless transfer band of a second transfer module carries toner particles of a second polarity in the region of the transfer printing location, the carrier material is guided at the transfer printing location between the first transfer band and the second transfer band, an electrostatic field is generated at the transfer printing location that effects that the toner particles of each and every transfer band separate from the respective transfer band as a result of electrostatic forces and adhere to the surface of the carrier material lying opposite the respective transfer band, whereby each transfer module contains a switchable transfer printing station, that, in a first operating mode (a collecting and printing mode), initially keeps the respective transfer band at a distance from the carrier material, whereas a plurality of toner images are arranged on top of one another on the respective transfer band, and the carrier material does not move forward at the transfer printing location, and then conducts the respective transfer band close to the carrier material in order to transfer the toner images arranged on top of one another there onto in common, and that, in a second operating mode (a continuous printing mode) conducts the respective transfer band close to the carrier material in order to continuously print monochromatic toner images onto the carrier printer.

BRIEF DESCRIPTION OF THE DRAWINGS

Exemplary embodiments of the invention are explained below on the basis of the drawings.

FIG. 24 is a perspective view of a cooperating electrode that is executed as a blade;

FIG. 25 is an enlarged illustration of a portion of a blade, whereby the blade is serrated;

FIG. 26 is a perspective illustration of a cooperating electrode that is composed of an arrangement of individual pins;

DETAILED DESCRIPTION OF THE PREFERRED EMBODIMENTS

Figure 1:
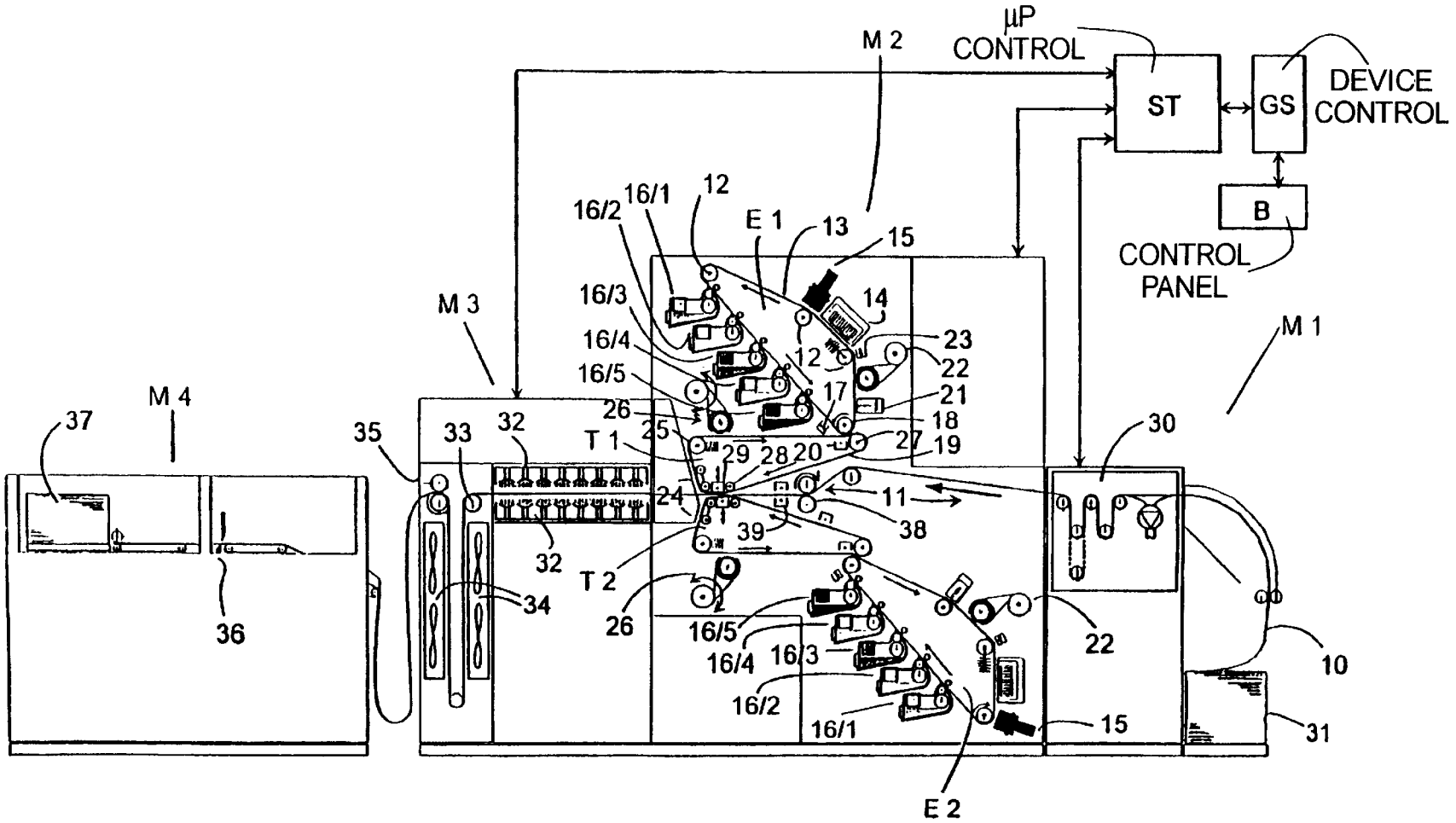
FIG. 1 is a schematic sectional view of an electrophotographic printer device for monochromatic and/or colored, single-sided or both-sided printing of a web-shaped carrier material, whereby the transfer station of the invention can be utilized.

The following preferred embodiments are presented without limitation to the scope of the claims.

According to the present invention, two transfer bands reside opposite one another at the transfer printing location, the toner particles thereof having different polarities. An electrostatic field is then generated that is directed such that the toner particles are repelled both from the first transfer band as well as from the second transfer band and agglomerate onto the respective surfaces of the carrier material. In this way, a simultaneous transfer printing is achieved. The transport path of the carrier material remains short since the carrier material need not be conducted past two printing stations or, respectively, past one printing station twice. Additionally, an interim fixing of the toner image which is transferred onto the carrier material is eliminated, as a result whereof the technical outlay is reduced and the printing quality remains high.

In a preferred exemplary embodiment, both transfer bands have toner images with toner particles of the same polarity in a section preceding the transfer printing location as seen in the delivery direction of the carrier material, whereby a transfer corotron is arranged preceding the transfer printing location along one of the transfer bands, this generating an electrical field that reverses the polarity of the toner particles on this transfer band as a result of the charge reversal. As a result of these measures, a uniform toner system, for example a positive or negative toner system with positive or, respectively, negative charging of the toner image, can be employed for both transfer bands. Accordingly, the printing quality is nearly identical on both sides of the carrier material.

Another exemplary embodiment is characterized in that two transfer drums reside opposite one another at the transfer printing location, and in that a DC voltage is applied to the transfer drums that generates the electrical field for the transfer printing of the toner particles. The transfer drums assure, on the one hand, a precise guidance of the carrier material and of the transfer bands in the region of the transfer printing location. On the other hand, they enable the build-up of an electrical field in the region of the transfer printing location in a simple way.

In practice, an exemplary embodiment has proven itself wherein two guide elements are arranged in front of the transferred drums as viewed in the delivery direction of the carrier material, the transfer bands and the carrier material being conducted between the two guide elements. In this way, the transfer bands and the carrier material are guided along a relatively great path distance given mutual touching. The fogging effect is reduced at the transfer printing location since the toner particles have only a slight or no spacing from the surface of the carrier material and a locationally exact transfer printing thus ensues.

According to another aspect of the invention, a corotron device is provided, this corotron device can be advantageously employed in conjunction with the transfer modules.

For printing a final image carrier, for example paper, a transfer of a toner image existing on an intermediate carrier onto the final image carrier is undertaken mechanically, thermodynamically or electrostatically. For an electrostatic transfer of the toner image from a photoconductive band onto an intermediate carrier or onto a final image carrier, the toner particles must have a certain voltage potential. The electrostatic transfer of the toner particles ensues due to forces in the electrical field and is based on a difference in potential between the toner particles and the final image carrier onto which the toner image is to be transferred. The force as a result of the electrical field must thereby be greater than the bonding forces with which the toner particles are held on the intermediate carrier for toner images from which they are to be transferred.

In electrographic printer and/or copier devices, dry toner particles are utilized for the electrographic transfer with a suitable voltage potential, so that the transfer of the toner particles onto a material can be implemented without additional charge influencing of the toner particles in the printer or copier. When the final image carrier is to be printed on both sides (duplex printing), the final image carrier must be turned over or a simultaneous or time-offset transfer of the toner particles ensues from both sides onto the final image carrier. In order to realize the transfer without interim fixing of the toner image transferred onto the final image carrier, the toner particles on the first side of the intermediate carrier must have a difference in potential compared to the toner particles of the second side. Preferably, the toner particles are reversed in charge from a positive voltage potential to a negative voltage potential with reference to the ground potential. The toner particles can thus be transferred simultaneously or time-offset without interim fixing, being transferred from the intermediate carrier onto the final image carrier from both sides. The toner particles on both sides of the final image carrier attract each other through the final image carrier due to their different potentials and/or are attracted by the difference in potential compared to the final image carrier, so that they adhere on the final image carrier.

After the transfer process, toner particles remain adhering to the intermediate carrier from which they are to be transferred, i.e. they have not been successfully transferred. This is thereby a matter of toner particles of a few percent of the toner image, usually substantially less than 20%. These toner particles that have not been transferred usually have a low or an incorrect voltage potential. In order to carry out a further transfer of these untransfered toner particles, for example for cleaning the intermediate carrier, with a high efficiency, it is necessary to charge the toner particles to a defined potential. This charging event ensues with a corotron device. The intermediate carrier thereby forms the cooperating electrode for the corotron device. When the intermediate carrier is of a conductive material having a specific resistance of less than $10^6$ ohms cm, then the intermediate carrier is applied to ground potential or to some other suitable voltage potential and thus serves as a cooperating electrode. When the intermediate carrier, for example in the case of a photoconductor, is provided with a light-sensitive cover layer whose dark resistance is an extremely high-impedance (for example, above $10^6$ ohms cm), a cooperating electrode must be arranged at the back side of the intermediate carrier. Cooperating electrodes are preferably implemented as metal plates or as conductive deflection rollers. Since deflection rollers involve high mechanical outlay, increased space requirements and high costs, metal plates are mainly utilized as the cooperating electrodes.

The cooperating electrode should have a low transfer resistance compared to the intermediate carrier. The intermediate carrier is conducted passed the stationary cooperating electrode in a non-contacting fashion. In order to achieve the low transfer resistance, the intermediate carrier must be conducted past the fixed cooperating electrode at a slight distance. This distance preferably amounts to 0.2 mm through 1.0 mm. The forces between two bodies whose difference in potential generates an electrical field are comparable to the forces between two plates of a plate capacitor, whereby one plate of the plate capacitor is formed by the cooperating electrode and the other plate is formed by the underside of the intermediate carrier. This force leads to deflection of the web-shaped intermediate carrier in the direction of the cooperating electrode at the cooperating electrode, so that the carrier touches and adheres to it. As a result of the contact between the moving web-shaped intermediate carrier and the stationary cooperating electrode, adhesion and sliding friction arise. The mechanical energy required in addition to the drive of the intermediate carrier due to this friction between the intermediate carrier and cooperating electrode must be provided by the drive unit of the intermediate carrier. Moreover, the intermediate carrier and/or the cooperating electrode becomes worn as a consequence of the sliding friction.

A corotron device is provided wherein low attractive forces occur between the intermediate carrier for toner images and the cooperating electrode and the charge carrier exchange is assured.

According to the new corotron device, the cooperating electrode has conductive elevations whose end points project in the direction of the corotron wire and that lie in a plane parallel to the longitudinal axis of the corotron wire. As a result of this fashioning of the cooperating electrode, what is achieved is that the attractive force between the intermediate and the cooperating electrode is substantially reduced. This attractive force is critically dependent on the effective area. The critical effective area is the area of the cooperating electrode facing toward the intermediate carrier. As a result of the arrangement of electrically conductive elevations, whose end points represent the critical effective area, it is assured that the effective area and, thus, the attractive forces between the intermediate carrier and the cooperating electrode are low. What is also achieved as a result of this arrangement is that an intensified exchange of charge carriers as a consequence of a spike discharge occurs due to the curvatures at the elevations.

A preferred embodiment provides that the elevations of the cooperating electrode are arranged along the longitudinal axis of the corotron wire. What is thereby achieved is that the electrical field for influencing the charge of the toner particles is uniformly formed and the arrangement of the cooperating electrode is possible in a space-saving fashion. Another embodiment is characterized in that the cooperating electrode contains individual pins as elevations. What is thereby achieved is that the cooperating electrode can be cost-beneficially manufactured of standardized component parts.

Another preferred embodiment is comprised therein that the cooperating electrode contains acutely tapering elevations. What is thereby achieved is that the effective area of the cooperating electrode and, thus, the attractive force between the intermediate carrier for toner images and the cooperating electrode is reduced further.

According to another aspect, it is provided in a corotron device for an electrographic printer and/or copier device that the cooperating electrode is fashioned like a blade having a cutting edge, whereby the cutting edge is arranged in parallel to the longitudinal axis of the corotron wire. What this development achieves is that, for example, a sheet metal plate that is arranged perpendicular to the intermediate carrier for toner images and proceeds over the width of the intermediate carrier for toner images, is utilized as the cooperating electrode. Such an arrangement is space-saving and cost-beneficial. What is also achieved by this arrangement is that an automatic exchange of charge carriers (to a spike discharge) arises due to the curvatures at the cutting edge.

Another beneficial embodiment of the corotron device provides that the cutting edge of the cooperating electrode is serrated and that the serrations taper in the direction of the corotron wire, so that the end points and/or end surfaces of the serrations project in the direction of the corotron wire and lie parallel to the longitudinal axis of the corotron wire. What is thereby achieved is that the effective area on which the amount of the attractive force between the intermediate carrier for toner images and cooperating electrode is dependent is reduced compared to the continuous blade, as a result whereof the attractive force is reduced farther. The spike discharge is promoted further.

According to another aspect, it is provided in a corotron device for an electrographic printer and/or copier device that the cooperating electrode is formed with a wire whose longitudinal axis is arranged parallel to the longitudinal axis of the corotron wire. What is achieved with this development is that, for example, a corotron wire is also provided as a cooperating electrode. This wire proceeds over the width of the intermediate carrier. Such an arrangement is space-saving and reduces the number of component parts utilized.

FIG. 1 shows a printer device for monochromatic and/or colored, single-sided or both-sided printing of a web-shaped carrier material, for example a paper web. The printer device is modularly constructed and has a delivery module M1, a printer module M2, a fixing module M3 and a post-processing module M4. The delivery module M1 contains elements for delivering a continuous form paper taken from a stacker to the printing module M2. This printing module M2 contains the transfer station that prints the carrier material that is subsequently fixed in the fixing module M3 and cut and/or stacked in the post-processing module M4.

The printer module M2 contains the units required for printing a web-shaped carrier material with toner images, these units being arranged at both sides of a transport channel 11 for the carrier material 10. These units essentially comprise two differently configurable electrophotographic modules E1 and E2 with appertaining transfer modules T1 and T2 that, together, form the transfer station T. The modules E1 and T1 are allocated to the front side of the carrier material 10; the modules E2 and T2 are allocated to the back side of the carrier material 10.

The essentially identically constructed electrophotographic modules E1 and E2 contain a preferably seamless photoconductive band 13 conducted over deflection rollers 12 and electro-motively driven in an arrow direction that, for example, is an organic photoconductor, also referred to as OPC. The units for the electrophotographic process are arranged along the light-sensitive outside of the photoconductive band 13. These units serve the purpose of generating toner images allocated to the individual color separations on the photoconductive band 13. To this end, the photoconductor 13 moving in the arrow direction is first charged to a voltage of approximately −600 V with the assistance of a charging device 14 and is discharged to approximately −50 V dependent on the characters to be printed and with the assistance of a character generator 15 composed of an LED comb.

The latent charge image generated in this way and situated on the photoconductor 13 is then inked with toner with the assistance of developer stations 16/1 through 16/5. Subsequently, the toner image is loosened with the assistance of the intermediate illumination means 17 and is transferred onto a transfer band 19 of the transfer band module T1 in an intermediate transfer printing region 18 with the assistance of a transfer corotron device 20. Subsequently, the entire photoconductive band 13 is discharged over its entire width with the assistance of the discharge corona device 21 and is cleaned of adhering toner dust via a cleaner device 22 having cleaning brushes. A subsequent intermediate illumination device 23 sees to a corresponding charge-wise conditioning of the photoconductive band 13 which, as was already set forth, is then uniformly charged with the assistance of the charging device 14.

Toner images allocated to individual color separations are generated with the electrophotography module E1 or, respectively, E2, the totality of these color separations forming the color image to be printed. To this end, the developer stations 16/1 through 16/5 are fashioned to be switchable. They respectively contain the toner allocated to an individual color separation. For example, the developer station 16/1 contains black toner, the developer station 16/2 contains toner having the color yellow, the developer station 16/3 contains toner having the color magenta, the developer station 16/4 contains toner having the color cyan and, for example, the developer station 16/5 contains blue toner or toner of a special color. Both single-component as well as two-component toner/developer stations can be employed as developer stations. Preferably, single-component toner developer stations are utilized, these working with fluidizing toner as known, for example, from U.S. Pat. No. 477,106 (Applicant: Fotland). The subject matter of this U.S. Patent is likewise a component part of the present disclosure and is incorporated herein by reference.

In order to achieve the switchability of the developer stations, i.e. in order to be able to individually actuate each individual developer station, these stations, given employment of fluidizing toner, can be fashioned in conformity with German Patent Application DE 196 52 866. The switching of the developer station accordingly ensues by changing the electrical bias voltage of the transfer drum or, respectively, by changing the electrical bias voltage of the applicator drum. It is also possible to switch the developer stations in that they are mechanically shifted and are thereby brought into contact with the photoconductive band 13. Such a principle is known, for example, from German Patent Document DE-A-196 18 324.

During operation of the printer device, a toner image that is allocated to an individual color separation is respectively generated by a single developer station with the assistance of the developer stations 16/1 through 16/5. This toner image is then electrostatically transferred onto the transfer band 19 via the transfer printing device 18 in combination with the transfer corona device 20. The transfer module T1 contains this transfer band 19, which is composed of a rubber-like substance, is conducted around a plurality of deflection devices and is motor-driven. The transfer band 19 is fashioned as an endless band and without a seam similar to the photoconductor band 13. It is moved in the arrow direction, namely proceeding from the transfer region with the drum 18 and the transfer corona device 20 to a transfer printing station 24 with transfer drums, is moved therefrom further around the deflection roller 25 to a cleaning station 26 and from the latter is in turn moved to the transfer region 18 and 20 with the deflection roller 27 arranged thereat.

The transfer band 19 in the transfer module T1 serves as a collector for the individual toner images allocated to the color separations that are transferred onto the transfer band 19 via the transfer device 18 and 20. The individual toner images are thereby arranged above one another, so that an overall toner image corresponding to the color image arises. In order to be able to generate the overall toner image and in order to be able to then transfer it onto the front side of the carrier material 10, the transfer module T1 contains a switchable transfer station 24. This, corresponding to the illustration in FIG. 1, can contain a plurality of mechanical displaceable transfer printing drums 28 with appertaining transfer printing corona device 29. In the operating condition of "collecting", the transfer printing drums 28 and the transfer printing corona device 29 are shifted upward according to the arrow direction, so that the transfer band 19 is spaced from the carrier material 10. The individual toner images are taken from the electrophotographic module E1 in this condition and are superimposed on the transfer band 19. The cleaning station 26 is deactivated by being pivoted out. The carrier material 10 is at rest in the region of the transfer printing station 24 in this operating condition.

The electrophotography module E2 and the transfer module T2 for the backside of the recording medium 10 are constructed corresponding to the modules E1 and T1. Here, too, an overall toner image is generated on the transfer band by collecting individual toner images for the backside, whereby the corresponding transfer printing station 24 is also pivoted away here in the operating condition of "collecting".

For a simultaneous printing of the front side and back side of the carrier material 10, the transfer bands 19 of the transfer module T1 and T2 are simultaneously brought into contact with the carrier material 10 in the region of the transfer printing stations 24 and the carrier material 10 is thereby moved. At the same time, the cleaning stations 26 of the transfer modules T1 and T2 are pivoted in and activated. After transfer of the two toner images onto the front side or, respectively, the back side of the carrier material 10, toner image residues adhering to the transfer bands 19 are removed by the cleaning stations 26. This is again followed by a collecting cycle for generating new toner images, whereby the transfer bands 19 are pivoted out and the carrier material 10 is at a standstill. The transfer of the toner images from the transfer modules T1 and T2 onto the carrier material 10 thus ensues given a start-stop operation of the carrier material 10.

The carrier material 11 is moved in the paper transport channel with the assistance of motor-driven transport drums 38. In the region between the transport drums 38 and the transfer printing stations 24, charging or, respectively, corona devices 39 can be arranged for paper conditioning so that the paper 10 is, for example, uniformly set in terms of charge before the transfer printing.

So that the carrier material 10 composed of paper does not tear given the start-stop mode and can also be continuously supplied, the delivery module M1 contains a loop forming means 30. This loop forming means 30 functioning as a web storage buffers the carrier material 10 which is continuously taken off from a stack holding device 31.

After the transfer printing of the two chromatic toner images in the region of the transfer printing stations 24 onto the carrier material 10, these must still be fixed. The fixing model M3 serves this purpose. It contains an upper and a lower row of infrared radiators 32 between which the paper transport channel for the carrier material 10 proceeds. The toner image located both on the front side as well as on the back side of the carrier material 10 and fixed by the infrared radiators 32 is still hot and soft and is guided free in non-contacting fashion over a deflection drum 33 arranged at the output side following the region of the infrared radiators 32. The fixing ensues with the heat generated by the infrared radiators 32. A cooling of the carrier material 10 as well as a smoothing, for example via corresponding decurler devices, ensues in a cooling path with cooling elements 34 and deflection rollers 35 following the infrared radiators 32. Lower-driven air chambers can serve as cooling elements 34. After the fixing of both toner images and cooling, a corresponding post-processing of the carrier material 10 ensues within the post-processing module M4 that, for example, can contain a cutter device 36 with stacking device 37.

A microprocessor-controlled control means ST coupled to the device controller GS serves the purpose of being able to realize the various operating conditions, the control means ST being in communication with the components delivery module M1, printer module M2 and fixing module M3 or, respectively, post-processing module M4 to be controlled and regulated. Within the modules, it is coupled to the individual units, thus, for example, to the electrophotography modules E1 and E2 and to the transfer modules T1 and T2. A control panel B via which the various operating conditions can be input is connected to the device controller GS or, respectively, to the control ST, which can be a component part of the device controller. The control panel B can contain a touch screen picture screen or, respectively, a personal computer PC with a coupled keyboard. The control itself can be conventionally constructed.

Figure 2:
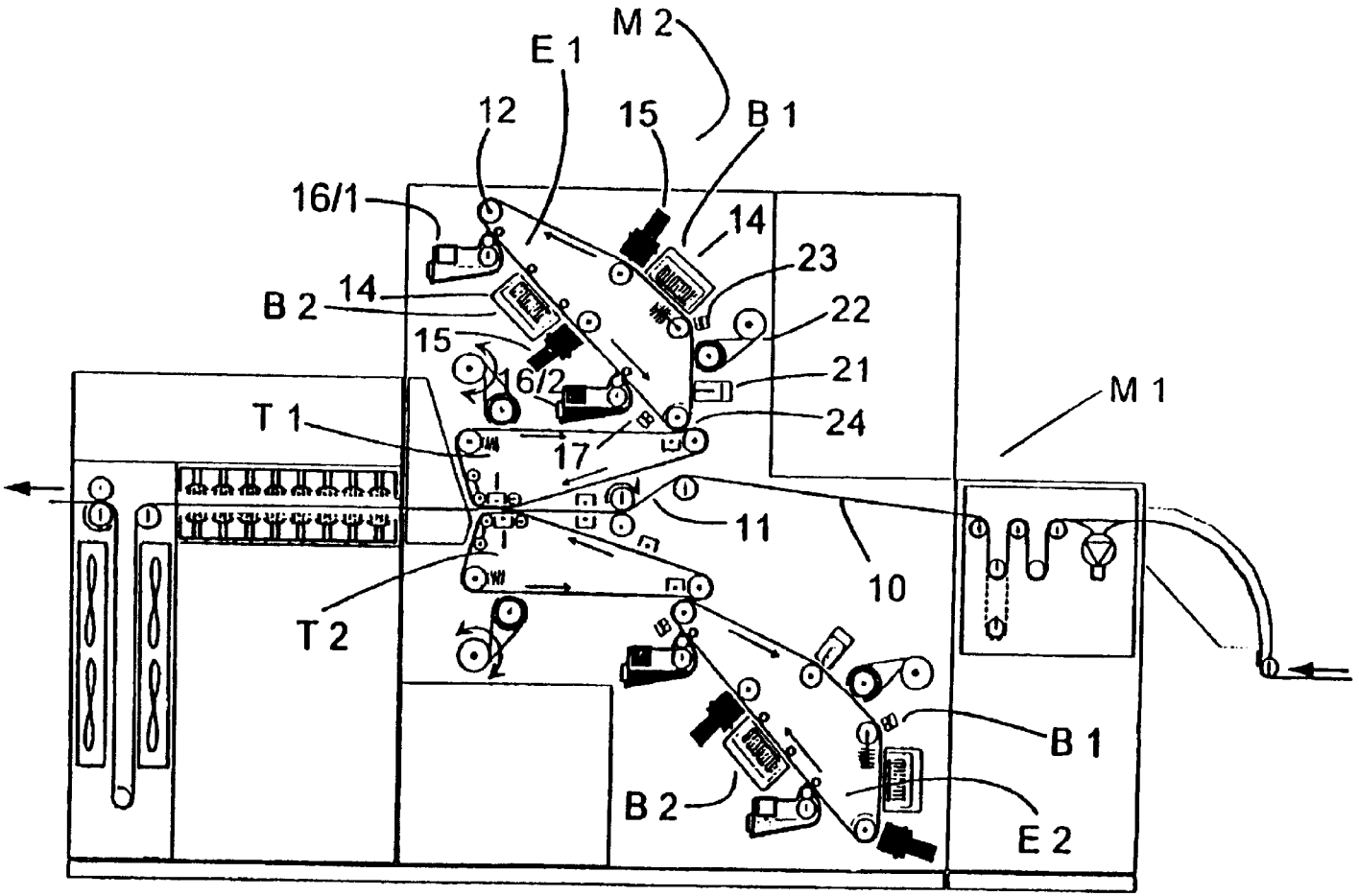
FIG. 2 is a schematic sectional view of a printer device according to FIG. 1 that prints the carrier material on both sides.

Given the embodiment according to FIG. 2, the electrophotography modules E1 and E2 contain two devices B1 and B2 that work independently from one another and generate images. The first image generating device B1 contains a character generator 15, a charging device 14, an intermediate illumination device 23, a cleaning device 22, a discharge corotron device 21 and a developer station 16/1. The second image-generating device B2 is constructed analogous thereto with a charging device 14, character generator 15, a development station 16/2 and an intermediate illumination device 17. The developer station 16/1 can be allocated to a first color, for example black, and the developer station 16/2 can be allocated to a second color, for example blue or some other color. With the assistance of the electrophotography modules E1 or E2, it is thus possible to generate a first toner image having the color black and to superimpose a toner image having the additional color on this black toner image with the second image-generating device B2. The toner image (spot color toner image) superimposed is in this way is then transferred onto the transfer modules T1 and T2 and is transferred from the latter directly onto the carrier material 10. It is thus possible to apply two-color toner images on both sides to the continuously moved carrier material 10. When only one of the image-generating devices B1 or B2 is activated, monochrome printing is continuously carried out. In both operating modes, the transfer modules T1 and T2 serve merely for the transfer of the toner images without needing the operating mode of "collecting". However, one can also imagine that both image-generating devices B1 and B2 be actuated in alternation and the transfer modules T1 and T2 in the operating mode of "collecting", as initially set forth.

Figure 3:
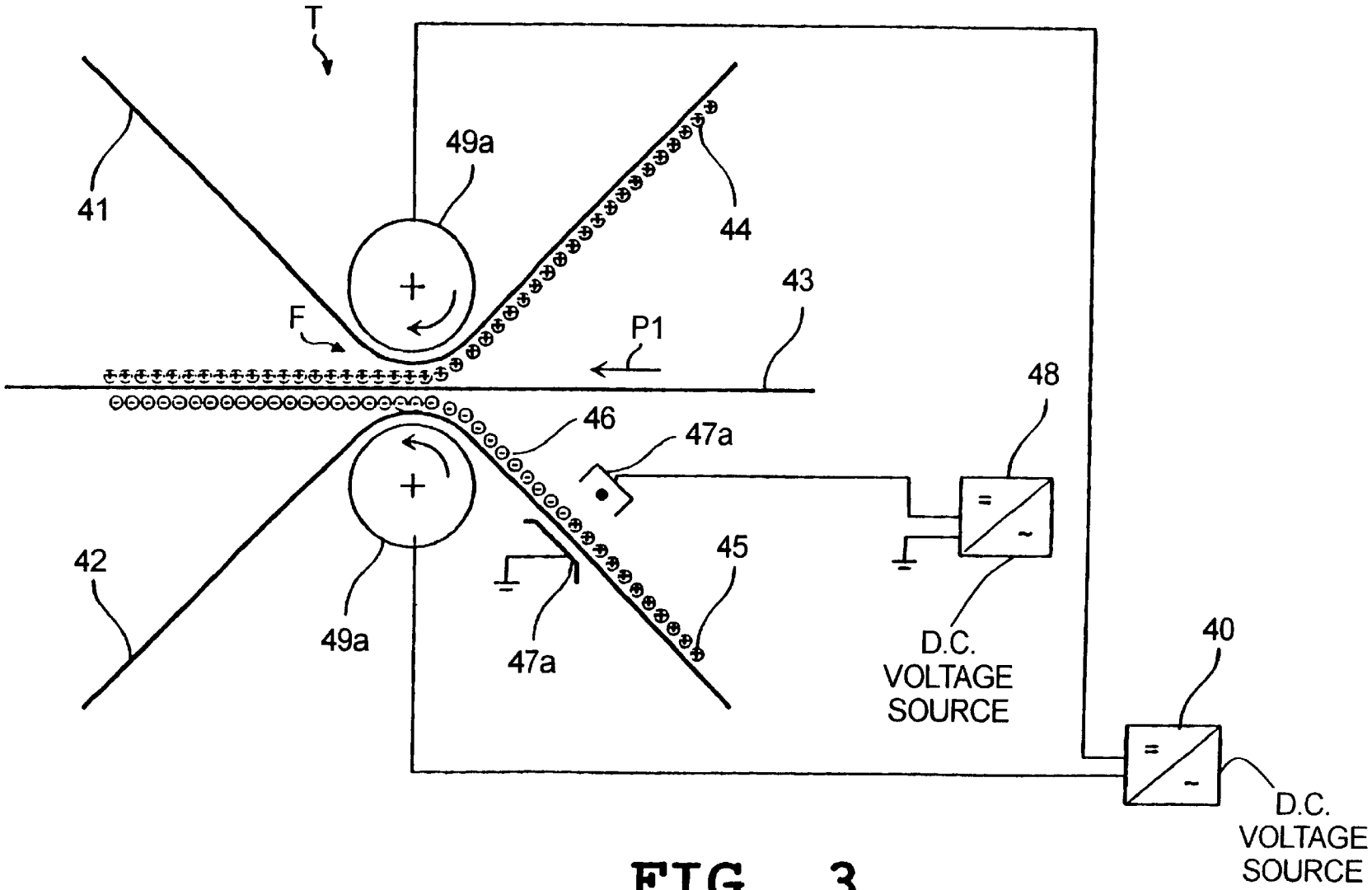
FIG. 3 shows schematically, an arrangement of critical parts of the transfer station with charge reversal of the toner particles.

The transfer devices T1 and T2 shown in FIGS. 1 and 2 belong to the transfer station T, whose critical parts are explained below with reference to FIGS. 3 through 21. FIG. 3 shows an exemplary guide example of the transfer station T, whereby two transfer drums are utilized. The toner image 44 for the front side of the carrier material 43 is located on the transfer band 41. The toner image 45 for the backside of the carrier material 43, which is preferably a paper web, is located on the second transfer band 42. The two toner images 44 and 45 have, for example, been transferred onto the transfer bands 41 and 42 with the assistance of the electrophotographic devices E1 and E2 according to FIG. 1. In the present instance according to FIG. 3, a positive toner system is employed, i.e. the toner particles have positive electrical charges after the application of the toner images 44 and 45, as indicated in FIG. 3. The carrier material 43, which is conveyed in the direction of the arrow P1, is located between the two transfer bands 41 and 42. Two electrically conductive transfer drums 49*a* and 49*b* guide the transfer bands 41 and 42 such that they touch the carrier material 43. An electrical DC voltage U is applied to the transfer drums 49*a* and 49*b*, the voltage being supplied from a DC voltage source 40. The transfer printing process ensues in the region of the transfer drums 49*a* and 49*b* facing toward one another, whereby toner particles are transferred from the transfer bands 41 and 42 onto the respective surface of the carrier material 43. This region is also referred to as a transfer printing location. A transfer printing corotron 47*a* is arranged at the transfer band 42 preceding the transfer printing location, the corotron 47*a* being supplied with negative DC voltage compared to ground from a DC voltage source 48. A ground electrode 47*b* resides opposite the transfer charge reversal corotron 47*a*.

Fundamentally, the transfer bands 41 and 42 can be composed of an insulating material or of a conductive material. The aim is that the transfer bands 41 and 42 as well as the carrier material 43 have the same surface velocities. Too great a relative motion of the surfaces relative to one another would cause a mechanical smearing of the toner images 44 and 45 and could thus negatively influence the printing quality.

Figure 4:
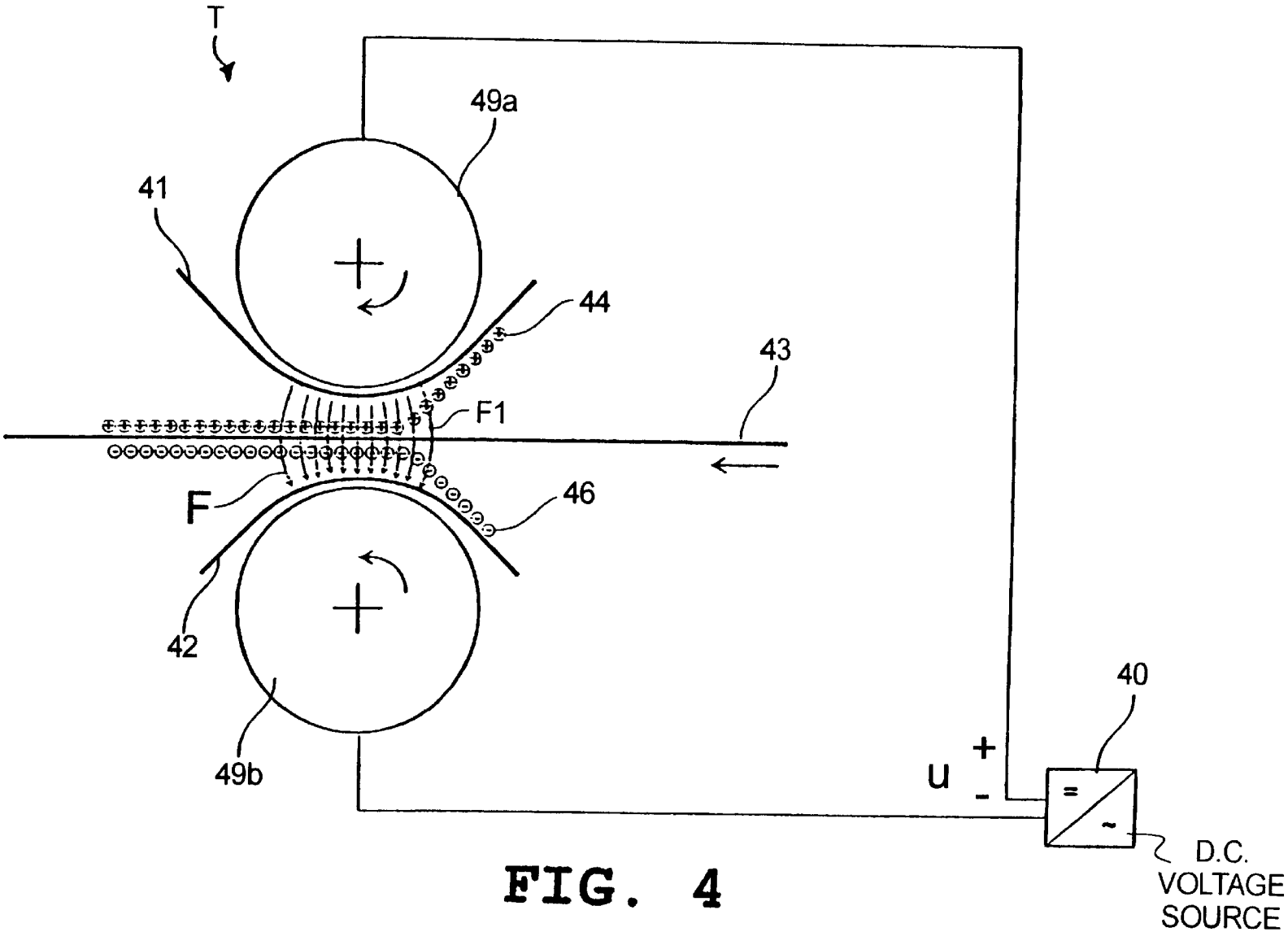
FIG. 4 is a detailed illustration of the arrangement according to FIG. 3 for explaining the function.

FIG. 4 shows the functioning of the simultaneous transfer printing given employment of a positive toner system. Due to the electrical field generated by the charge reversing corotron 47*a* (shown in FIG. 3), the polarity of the toner particles arranged on the lower transfer band 42 is reversed, i.e. the toner particles 46 no longer have a positive charge but a negative charge, as indicated in FIGS. 3 and 4. The toner particles of the toner image 44 continue to be positively charged. As a result of the voltage U applied to the transfer drums 49*a* and 49*b*, an electrostatic field F forms whose field lines proceed dependent on the shape of the transfer drums 49*a* and 49*b*, i.e. particularly dependent on the radius of curvature. It is indicated in FIG. 4 that the electrical field F is largely uniform in the plane of the middle axes of the transfer drums 49*a* and 49*b* and becomes less uniform toward the edge along the plane of the carrier material 43. Dependent on the electrical field strength that can be set with the voltage U, the toner particles of the upper toner image 44 separate from the transfer band 41 and deposit on the front side of the carrier material 43. Since the potential of the upper transfer drum 49*a* is positive, a repellant force derives for the toner particles of the toner image 44 that effects the agglomeration of the toner particles on the surface of the carrier material 43. The lower transfer drum 49*b* has a negative voltage potential referred to the potential of the toner particles 46 having a negative charge. Accordingly, these toner particles 46 are repelled from the surface of the lower transfer band 42, migrate opposite the direction of the electrical field F to the back side of the carrier material 43 and agglomerate thereat.

Isolated toner particles can already separate early in the non-uniform region, for example in the region of the field line F1, of the electrical field F. Due to the inhomogeneity of the field and due to the increased distance between the surfaces of the carrier material 43 and the transfer bands 41 and 42, the point of incidence of the toner particles on the carrier material 43 is not exactly defined; a fogging effect can occur that is known under the technical term of "fogging". This effect is discussed in greater detail later.

Figure 5:
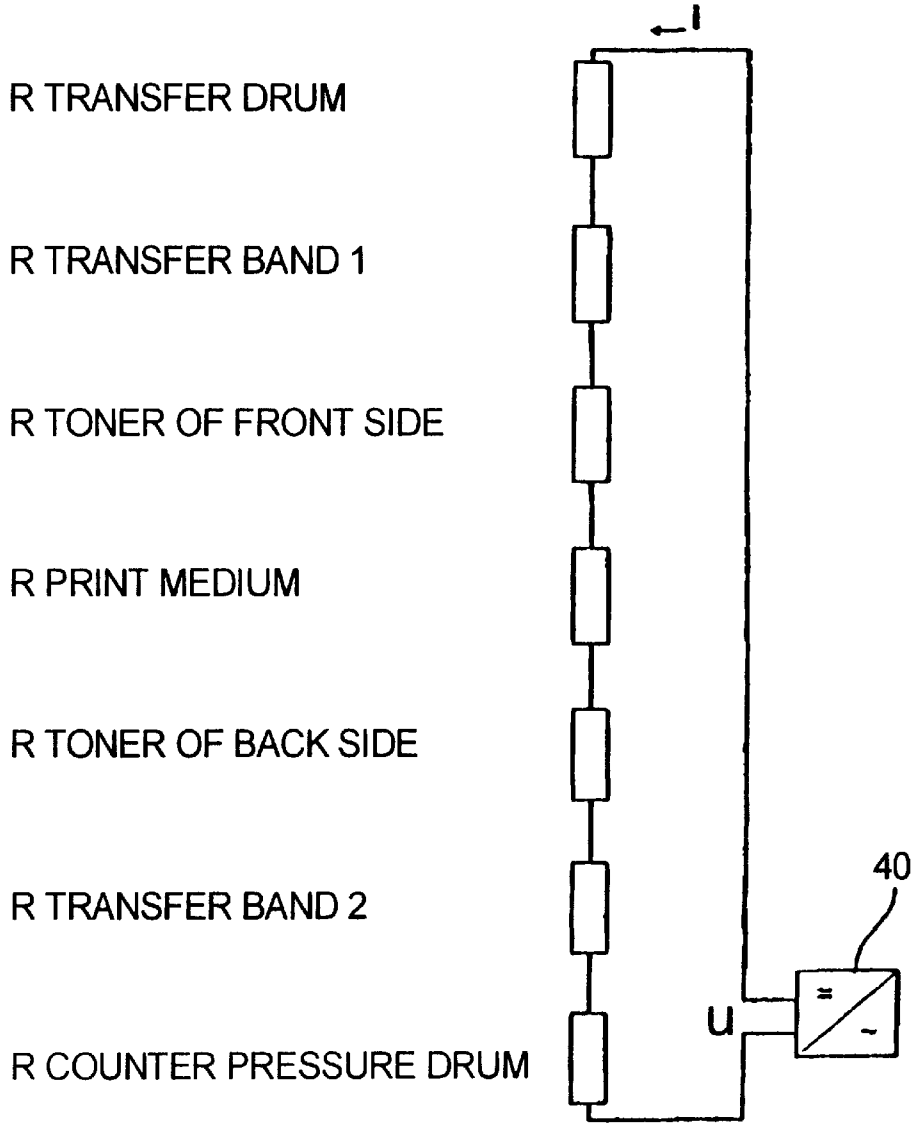
FIG. 5 is an electrical equivalent circuit diagram that reflects the resistance conditions and conditions of the current at the transfer printing location.

FIG. 5 shows an electrical equivalent circuit diagram that is shown as a circuit having series resistors R. The flowing current i derives from Ohm's law, i.e. the current i is the quotient of the voltage U divided by the sum of the individual resistors R. The aim is that the resistors R of the two transfer drums 49*a* and 49*b* are as small as possible. This can be realized with the assistance of conductive materials, i.e., for example, transfer drums of metal are employed. It is also to be provided that the resistors R of the transfer bands 41 and 42 are as large as possible so that the overall current i remains small. Given a great overall current i, namely, the wear of the transfer bands 41 and 42 is increased. The resistance R of the transfer bands 41 and 42 must, however, assume a finite value so that the electrical field F forms with high intensity at the surface of the respective transfer bands 41, 42. When, namely, the resistance R of the transfer bands 41 and 42 is too high, then the effective distance for the electrical field F is increased; it extends from the surface of the transfer drum 49*a* up to the surface of the transfer drum 49*b*. Given the same voltage U, the field strength within the field F is then attenuated. Given a certain conductivity of the transfer bands 41 and 42, the effective distance for the electrical field F between the transfer bands 41 and 42 is reduced and, thus, the field strength is increased given a voltage U that remains the same.

Figure 6:
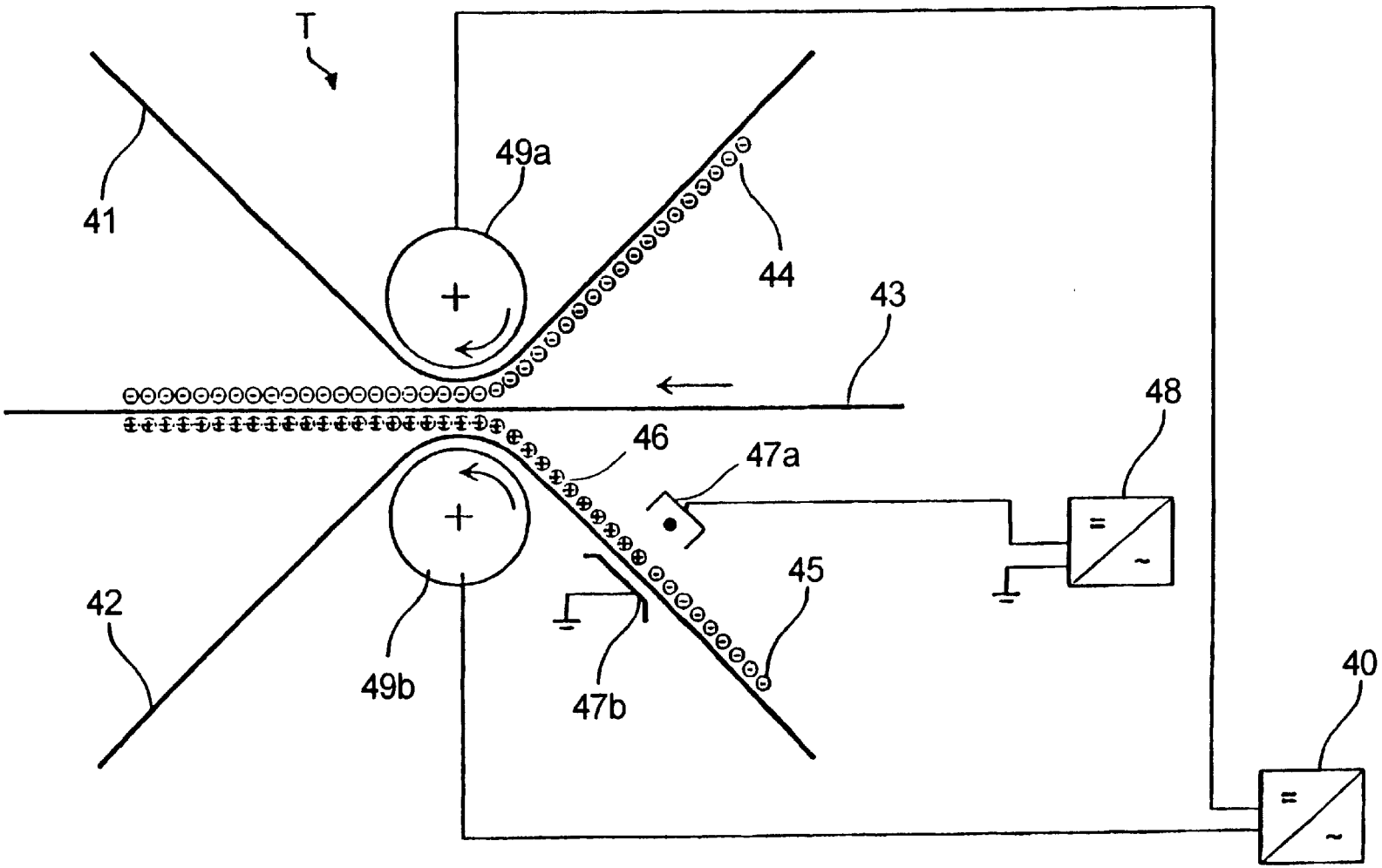
FIG. 6 is a side view of an arrangement similar to that of FIG. 3 with a negative toner system.

FIG. 6 shows critical parts of the transfer station T given employment of a negative toner system, i.e. wherein the charges of the toner particles are negatively charged after application onto the transfer bands 41 and 42. The polarity reversal is again effected by the charge reversing core 47*a* that, however, has positive potential in this case. Likewise, the transfer drums 49*a* and 49*b* are driven with a voltage U, so that an electrical field arises whose field strength reverses compared to the exemplary embodiment of FIG. 3. The function of the transfer printing corresponds to that described up to now but merely with an inverted operational sign of the charge and of the field strength.

Figure 7A:
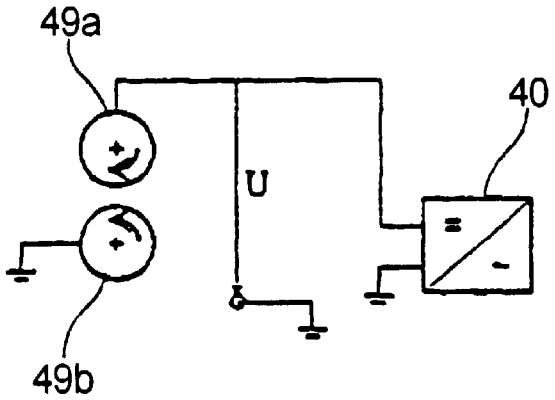
FIGS. 7*a*, 7*b*, 7*c* and 7*d* are electrical diagrams that show schematically, the possible relationships of potential at the transfer printing drums.
Figure 7B:
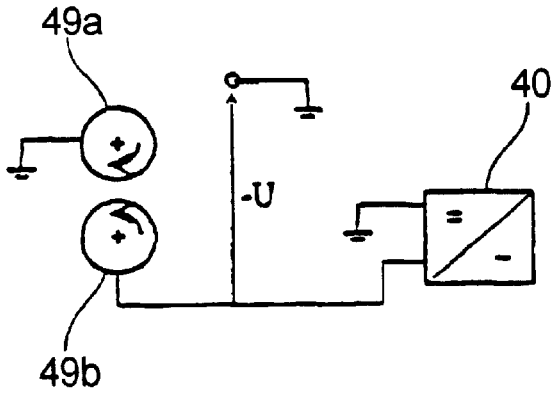
Figure 7C:
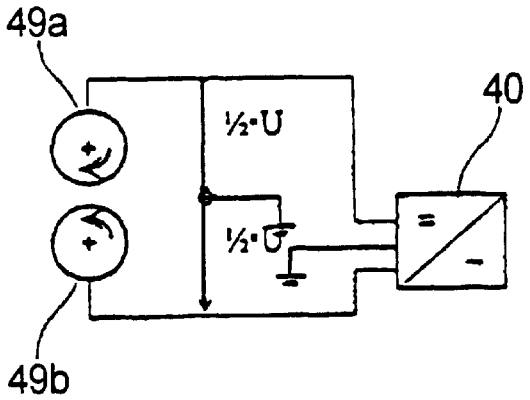
Figure 7D:
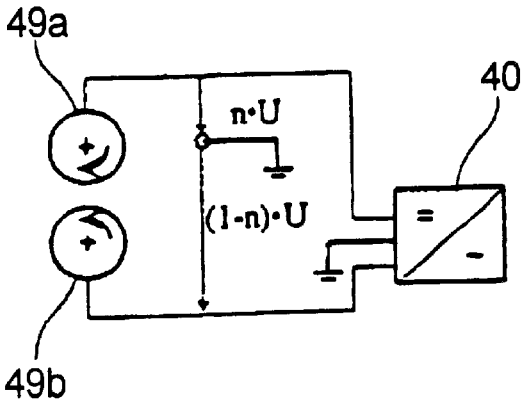

FIGS. 7*a*, 7*b*, 7*c* and 7*d* show the possible relationships of potential at the transfer drums 49*a* and 49*b*. One of the transfer drums 49*a* and 49*b* is at ground in FIGS. 7*a* and 7*b*. Likewise, one electrode of the DC voltage source 40 is applied to ground. FIG. 7*c* shows a symmetrical voltage drive whereby the voltage mid-point is applied to ground. FIG. 7*d* shows an asymmetrical voltage drive for the transfer drums 49*a* and 49*b*.

Figure 8:
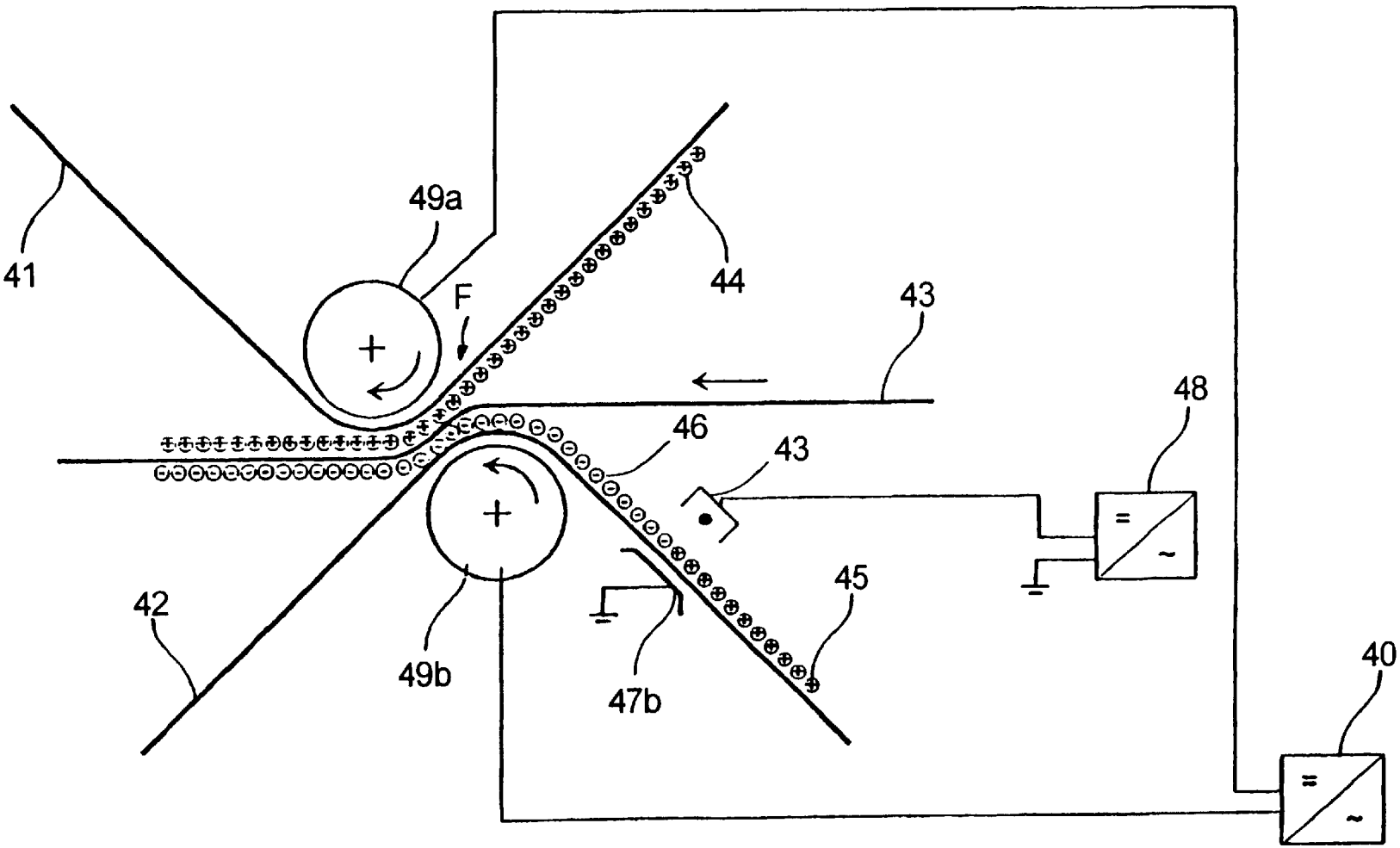
FIG. 8 is a side view of an exemplary embodiment wherein the transfer bands partially wrap around the transfer drums.

FIG. 8 shows a development of the arrangement according to FIG. 3. The carrier material 43 to be printed is guided such by the transfer drums 49*a* and 49*b* that it wraps around the transfer drums 49*a* and 49*b* by a respective, predetermined wrap angle. In this way, the region wherein the respective toner image 44 or, respectively, 45 lies against the surfaces of the carrier material 43 is enlarged. Inhomogeneities of the electrical field F at the edge thereof have a less pronounced effect; the fogging effect is reduced.

Figure 9:
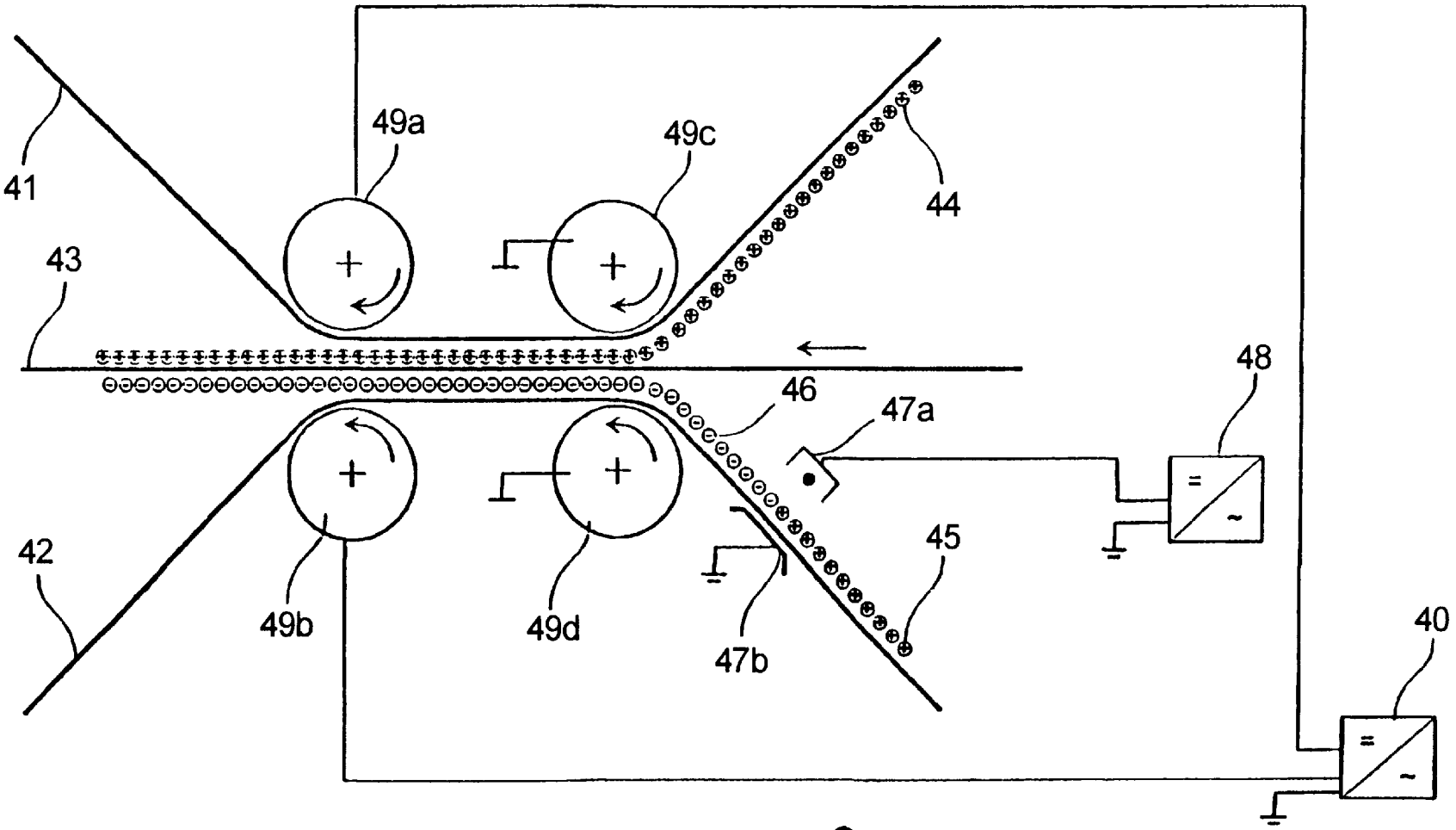
FIG. 9 is a side view of an exemplary embodiment with guide rollers.
Figure 10:
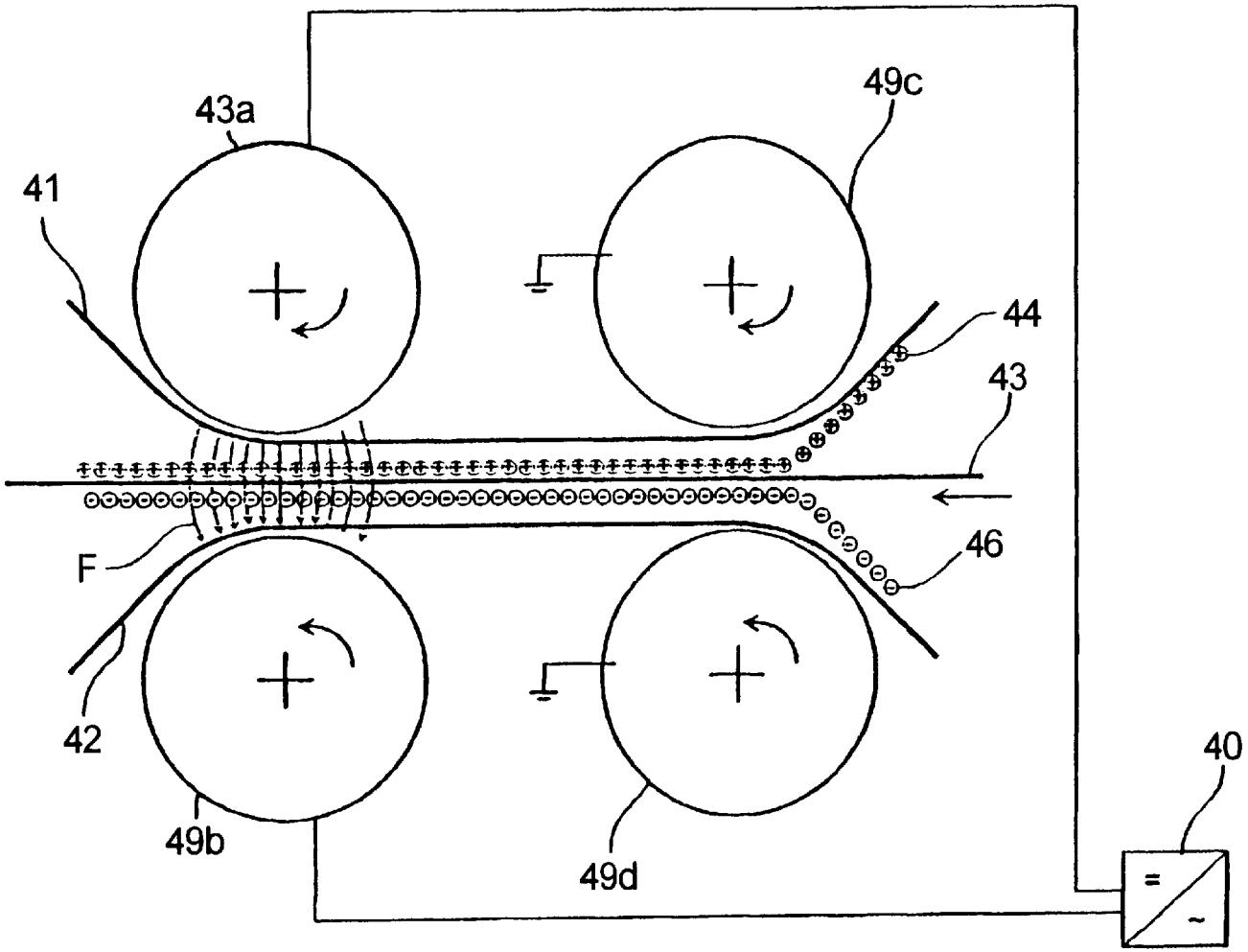
FIG. 10 is a detailed illustration of the arrangement according to FIG. 9.

FIG. 9 shows an exemplary embodiment which is shown in detail in FIG. 10 wherein two guide rollers 49*c* and 49*d* between which the transfer bands 41 and 42 as well as the carrier material 43 are guided are arranged preceding the transfer drums 49*a* and 49*b* as shown in the feed direction of the carrier material 43. The two guide rollers 49*c* and 49*d* are applied to ground potential, whereas the voltage U for generating the electrical field is applied to the transfer drums 49*a* and 49*b*. The two guide rollers 49*c* and 49*d* bring the transfer bands 41 and 42 into contact with the carrier material 43 or, respectively, reduce the spacing to a minimum. When, given forward conveying, the toner images 44 and 46 reach the non-uniform region (see FIG. 4) of the electrical field and the first toner particles are transferred onto the surface of the carrier material 43, then the flight path for these toner particles is minimal or, respectively, equal to zero, and a topically exact toner transfer ensues. The fogging effect is avoided in this way and a high print quality is achieved.

Figure 11:
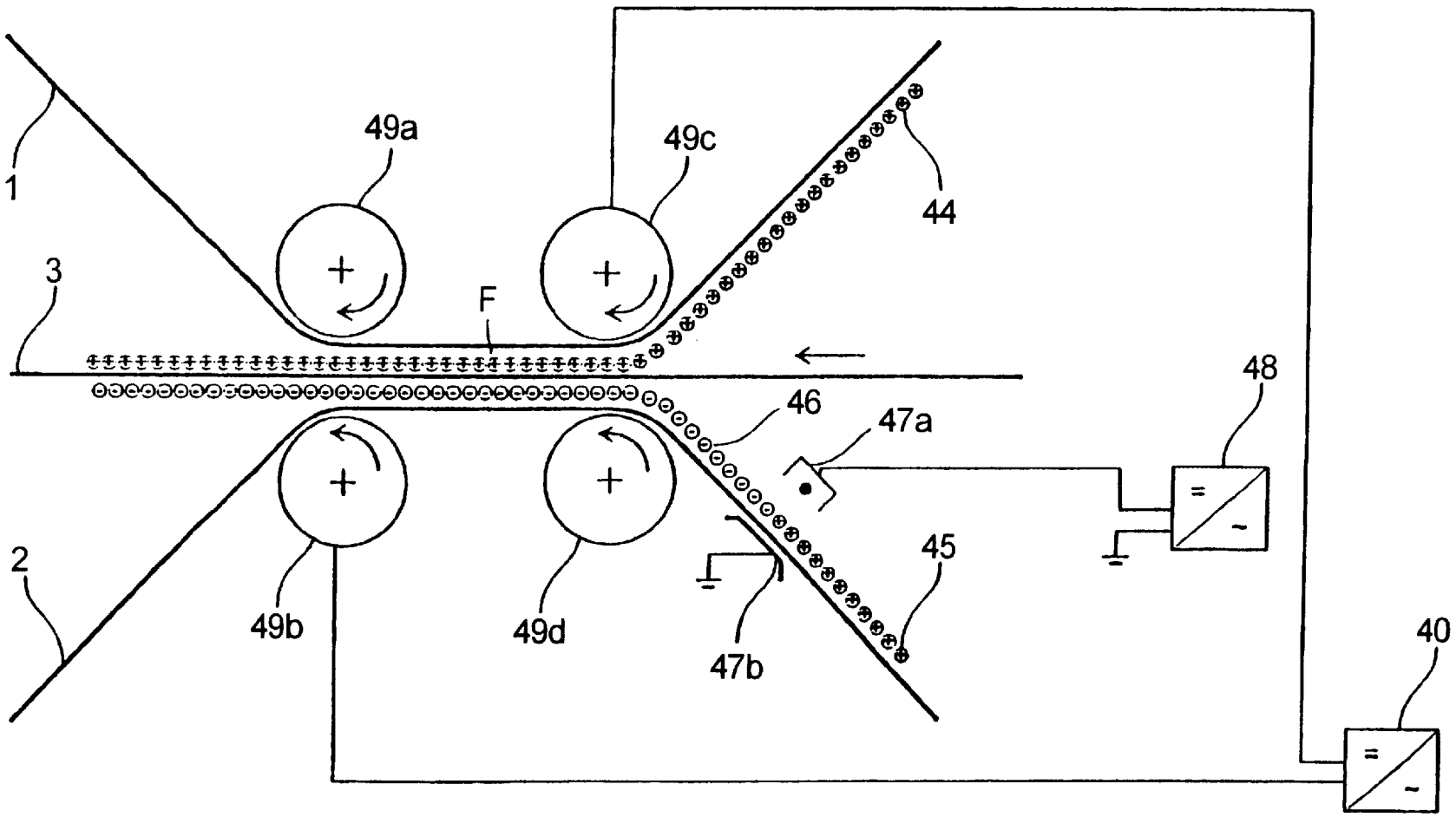
FIG. 11 is an arrangement similar to that of FIG. 9, whereby the electrical field required for the transfer printing is built up between the guide roller and the transfer drum.

FIG. 11 shows a modification of the exemplary embodiment according to FIG. 9. The lower transfer drum 49*b* and the upper guide roller 49*c* are charged with a voltage potential such that the electrical field F takes effect between the drum 49*b* and roller 49*c*. The transfer drum 49*a* and the guide roller 49*d* are seated in an insulated fashion and have a floating potential. As a result of these measures, the electrical field F required for the transfer printing is effective over a longer distance, so that the transfer printing process proceeds more gently since the effective area on which the transfer of the toner particles from the transfer bands 41 and 42 onto the surface of the carrier material 43 ensues is enlarged.

Figure 12B:
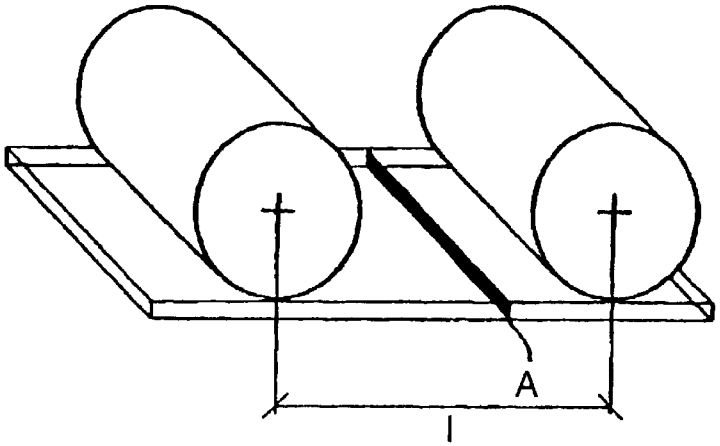
FIGS. 12*a* and 12*b* are an electrical equivalent circuit diagram directed to the exemplary embodiment according to FIG. 11 and a perspective view of the drums.
Figure 12A:
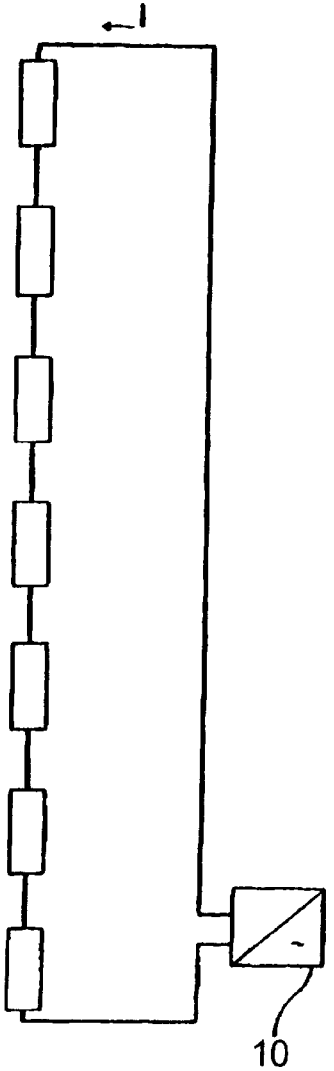

FIG. 12 a schematically shows the physical relationships on the basis of an electrical equivalent circuit diagram. When the specific material resistance ρ of the transfer bands 41 and 42 employed is low, then relatively high current i result as a result of Ohm's law. Given a permanently applied voltage U, this can yield an undesirably high electrical power P according to the relationship:

$$P=U\cdot i.$$

Due to inhomogeneities of the materials for the transfer bands 41 and 42, local current spikes are possible that allow the electrical field to briefly collapse and, thus, disturb the process of transfer printing. As a result of an increase of the spacing between the drums that form the electrodes for the electrical field, the electrical resistance R of the transfer bands 41 and 42 is increased, as is that of the carrier material 43. The current i that flows reduces correspondingly on the basis of the relationship $$R=\rho\cdot l/A,$$

wherein R is the overall electrical resistance, ρ is the specific electrical material resistance of the transfer bands, l is the effective material length and A is the effective material cross-section, as shown in FIG. 12*b*.

Figure 13:
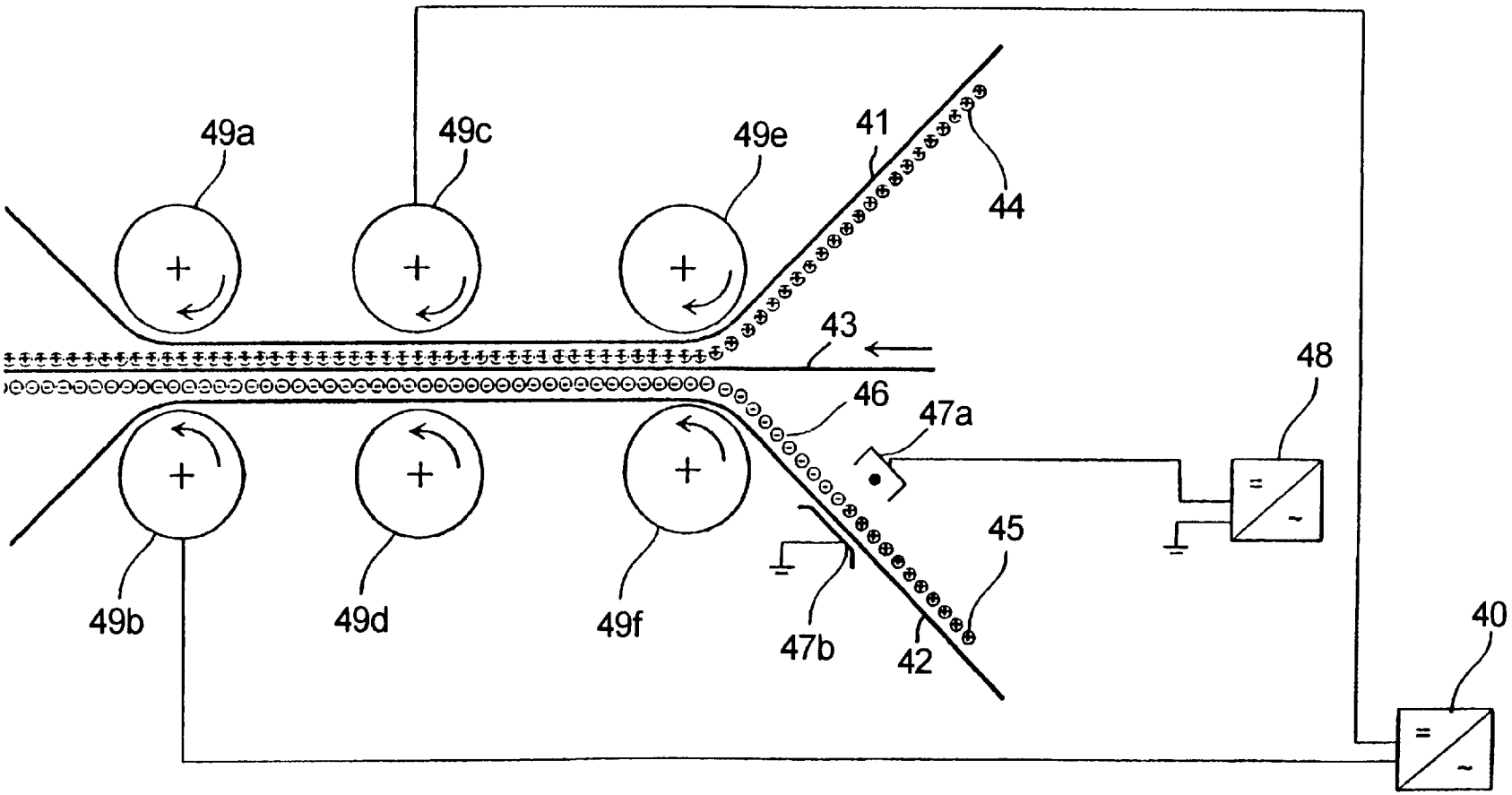
FIG. 13 is an arrangement according to FIG. 11, whereby additional delivery rollers are provided.

FIG. 13 shows a combination of the exemplary embodiments according to FIGS. 9 and 11. Two delivery rollers 49*e* and 49*f* between which the transfer bands 41 and 42 and the carrier material 43 are guided are arranged preceding the guide rollers 49*c* and 49*d*. The delivery rollers 49*e* and 49*f* carry ground potential, whereas the arrangement of the drums 49*a* and 49*b* and rollers 49*c* and 49*d* as well as the carrying of the potential thereof corresponds to that of FIG. 11. In this way, an electrically neutral zone arises in the region of the delivery rollers 49*e* and 49*f*, whereby the attractive forces of the toner particles with different potential can be left out of consideration. A premature jumping of toner particles in the region of increased distance between the transfer bands 41 and 42 is thus avoided.

Figure 14:
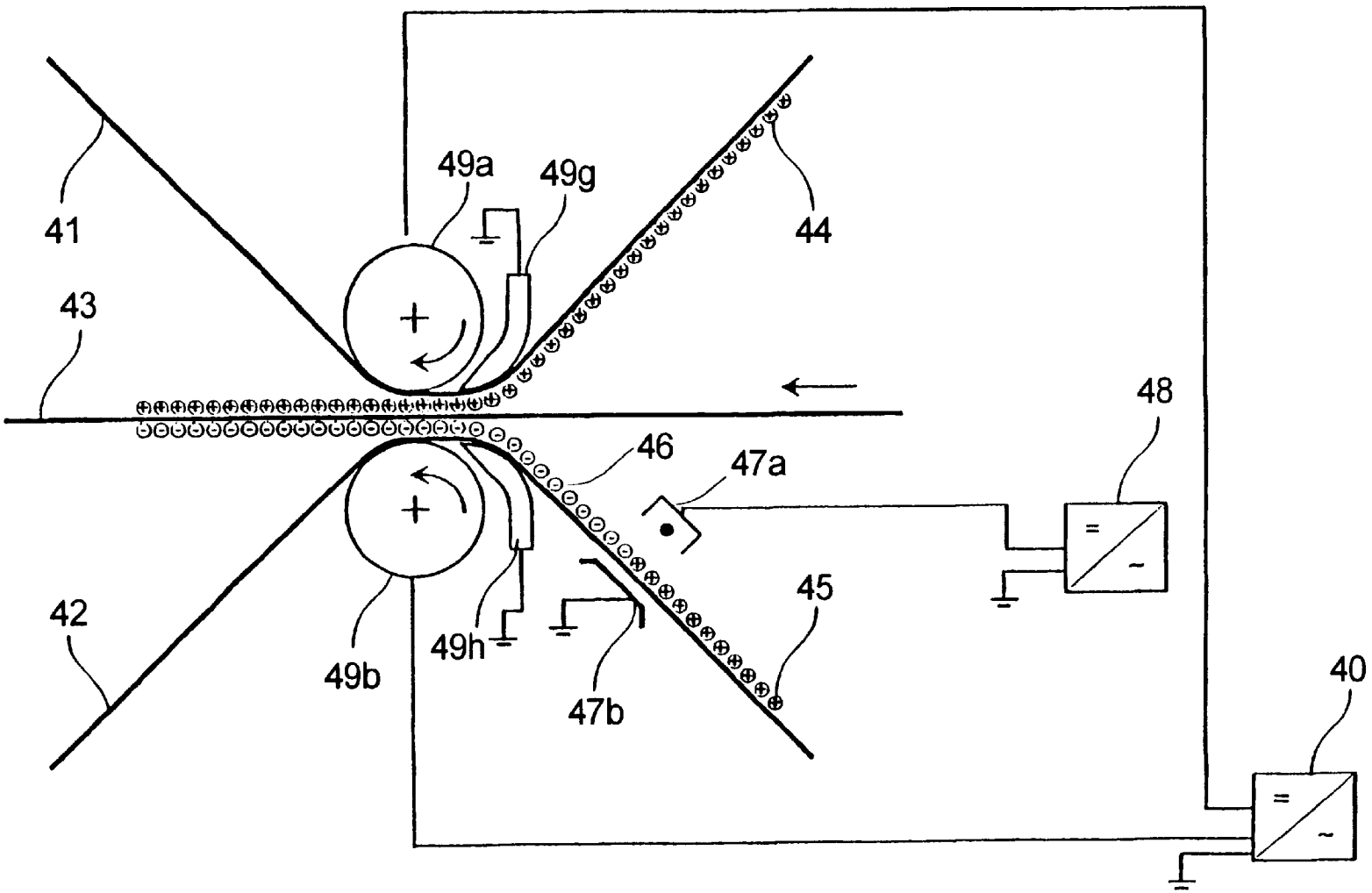
FIG. 14 is an exemplary embodiment with deflection bows.

FIG. 14 shows a modification of the arrangement according to FIG. 9. Grounded deflection bows 49*g* and 49*h* are employed instead of the grounded guide rollers 49*c* and 49*d*. These deflection bows 49*g* and 49*h* can be arranged close to the transfer drum 49*a* and 49*b*, as a result whereof the length of the contact of the transmission bands 41 and 42 with the carrier material 43 is shortened. When the arrangement according to FIG. 9 is compared to that according to FIG. 14, then it can be seen that the minimum path wherein there is contact between the transfer bands 41 and 42 and the carrier material 43 in FIG. 9 is the sum of the radii of the transfer drums 49*a* or, respectively, 49*b* and of the guide rollers 49*c* or, respectively, 49*d*. When velocity differences dv between the velocity of the transfer bands 41 and 42 and the carrier material 43 occur, then this leads to a mechanical slip and, thus, to an undesired smearing of the toner images to be transferred. The smearing effect is all the greater the longer the contact path is or, respectively, the greater the velocity difference is. The reduction of the velocity difference between the transfer bands 41 and 42 and the carrier material 43 is hardly possible in practice since length tolerances given pre-print forms must be compensated. In order to nonetheless keep the smearing effect low, the length of the contact between transfer band 41 and 42 and the carrier material 43 is reduced according to the exemplary embodiment of FIG. 14 in that narrow deflection bows 49*g* and 49*h* are employed whose sliding surfaces can be arranged close to the surface of the transfer drums 49*a* and 49*b*. In order to reduce frictional forces, it is meaningful to provide the deflection bows 49*g* and 49*h* with a friction-reducing layer, for example with a layer of a fluorine-containing plastic material, for example PFA, ETFE, FEP, PFDC, Teflon or polyimide (PI). The surface wear of the deflection bows 49*g* and 49*h* can be reduced in that hard, wear resistant materials, for example chromium nickel steel, VA steel, are employed or in that the deflection bows 49*g* and 49*h* are provided with a layer of a wear-reducing material, for example by nickel-plating, by employing silicate or with the assistance of a surface hardening.

Figure 15:
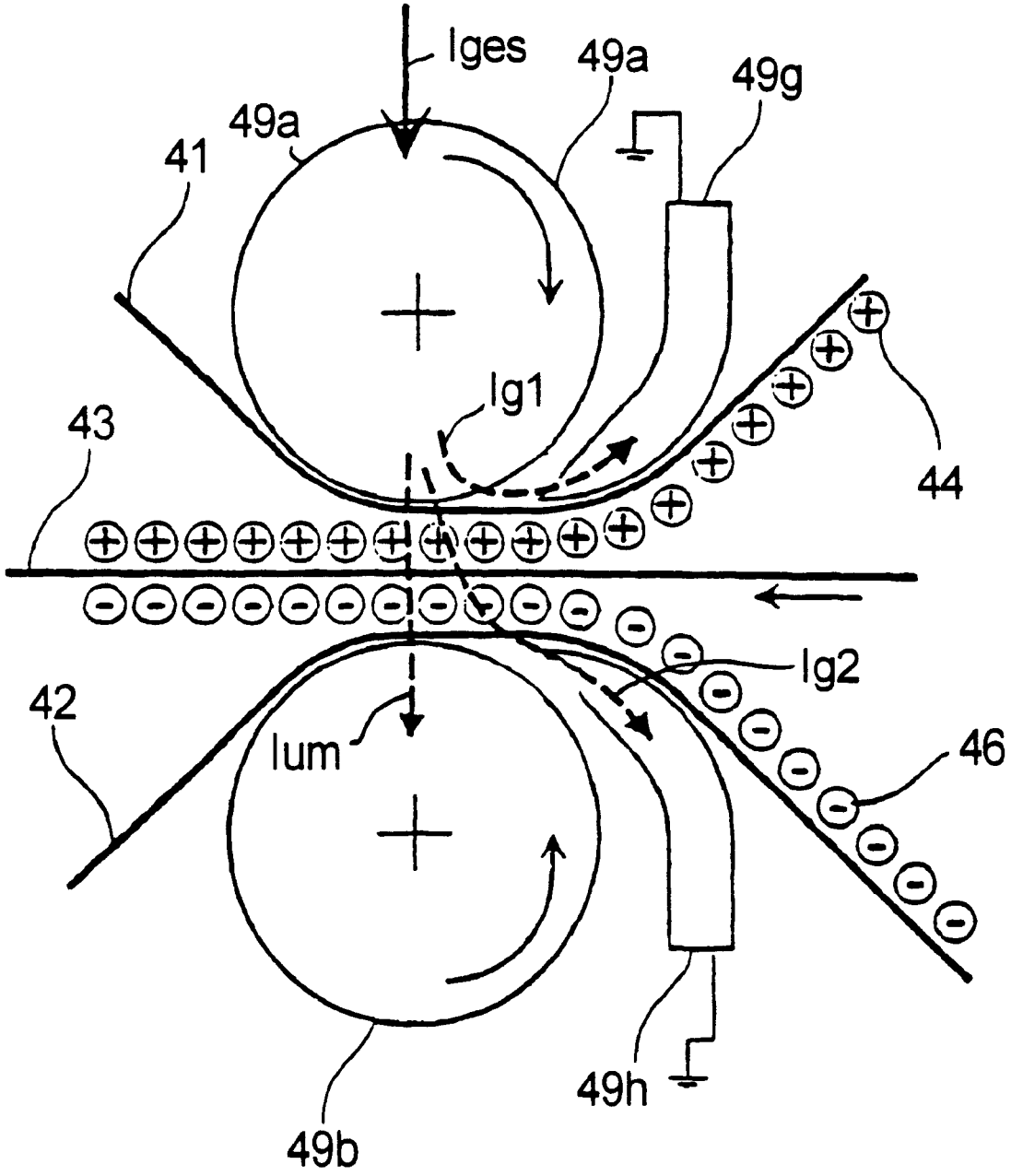
FIG. 15 is an enlarged side view showing the conditions of the current in the exemplary embodiment according to FIG. 14.
Figure 16:
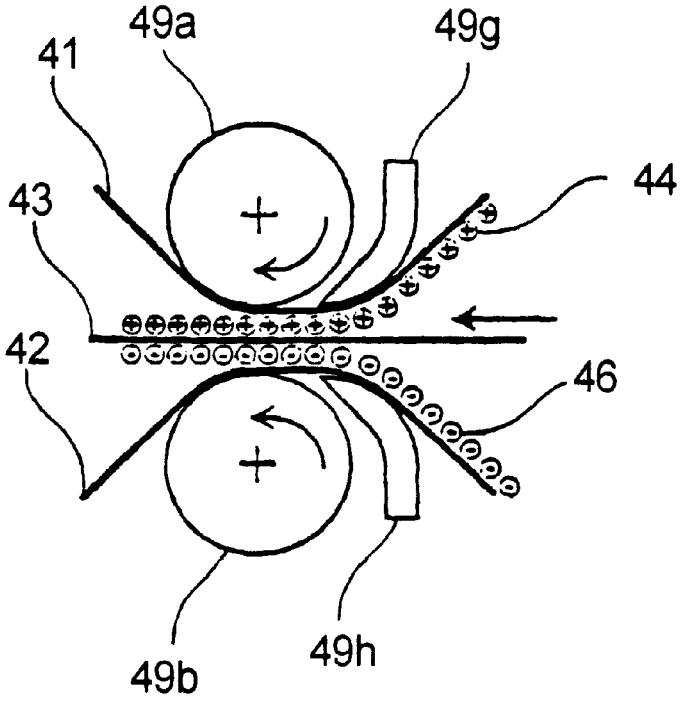
FIG. 16 shows the exemplary embodiment according to FIG. 14 with insulated deflection bows.

FIG. 15 shows the relations of the current given the example of FIG. 14, whereby the deflection bows 49*g* and 49*h* lie at ground potential. The overall current Iges derives from the sum of the currents Ium at the transfer printing location and the quadrature-axis currents Iq1 and Iq2. The aim is that $$Ium>>Iq1+Iq2$$

applies or that $$Iq1=Iq2=0$$

applies. When the quadrature-axis current components Iq1 and Iq2, which flow directly into the grounded deflection bows 49*g* and 49*h* through the transfer bands 41 and 42 are undesirably high, then the deflection bows 49*h* and 49*g* can also be arranged so as to be electrically insulated, so that they assume a floating potential (see FIG. 16).

Figure 17:
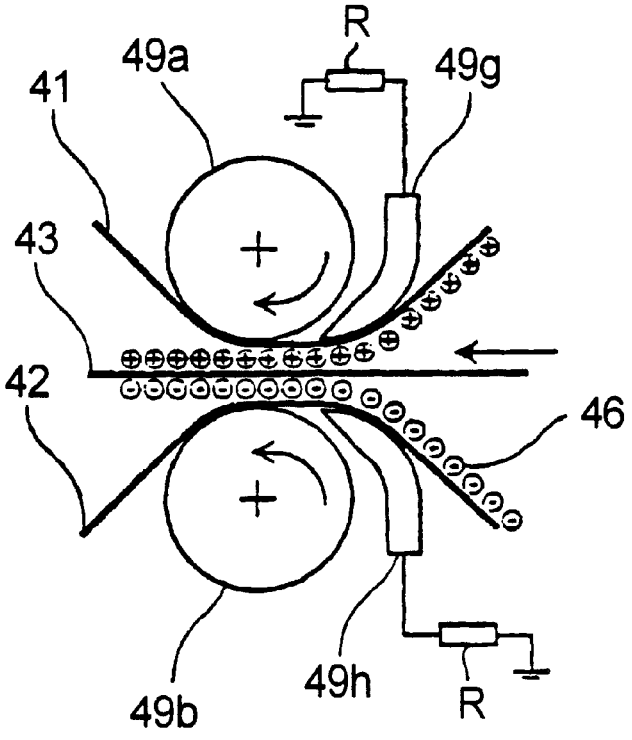
FIG. 17 shows an exemplary embodiment having electrically conductive deflection bows that are conducted to ground potential via a resistor.

FIG. 17 shows an exemplary embodiment wherein the deflection bows 49*g* and 49*h* are electrically conductive but are connected to ground potential via a resistor R. In this exemplary embodiment according to FIG. 17, too, the quadrature-axis current components are reduced.

Figure 18:
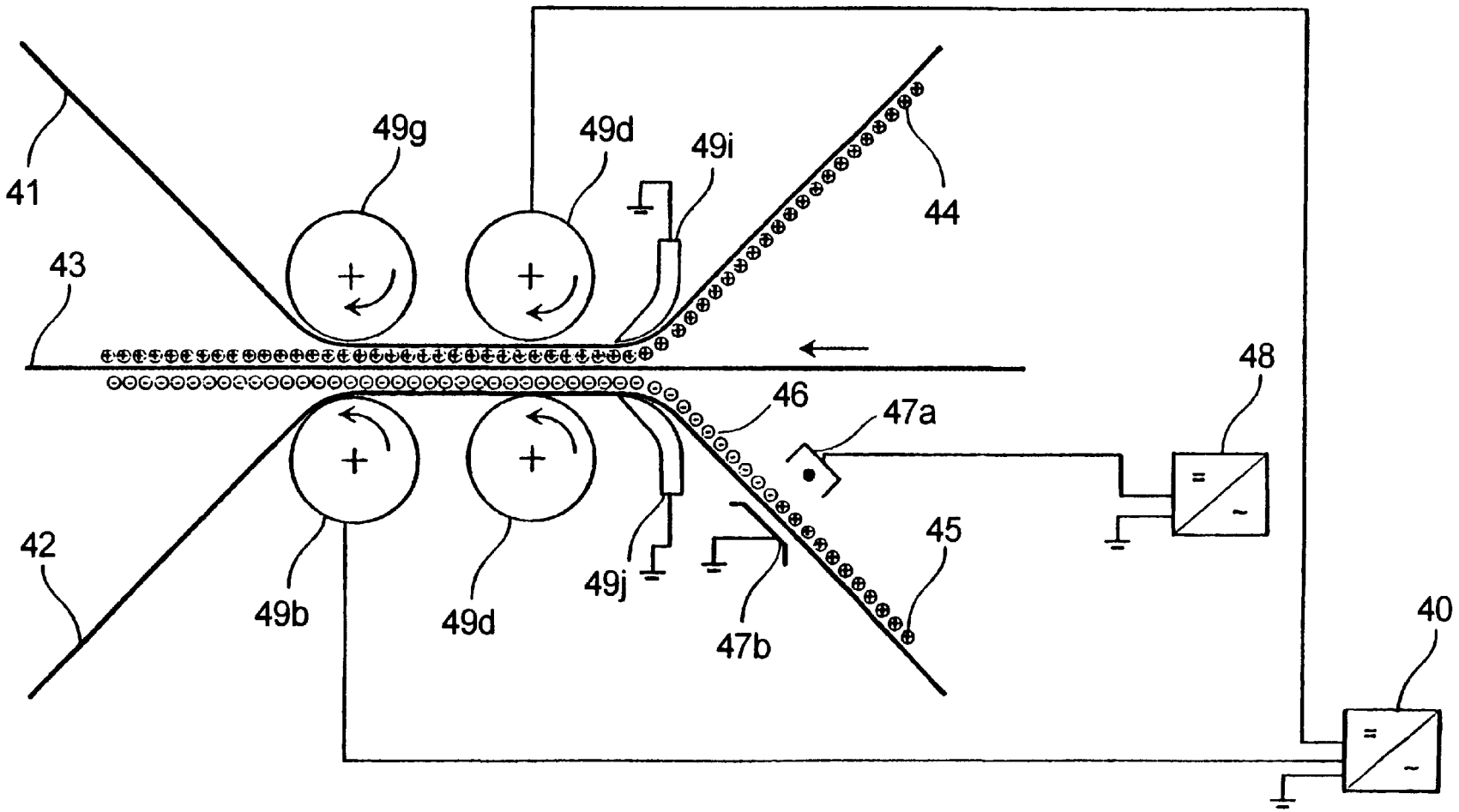
FIG. 18 is a side view of an exemplary embodiment similar to that of FIG. 13.

FIG. 18 shows a modification of the exemplary embodiment according to FIG. 13. The delivery rollers 49*e* and 49*f* are replaced by deflection bows 49*i* and 49*j*. These deflection bows 49*i* and 49*j* can be electrically fashioned as indicated in the examples according to FIGS. 16 and 17.

Figure 19A:
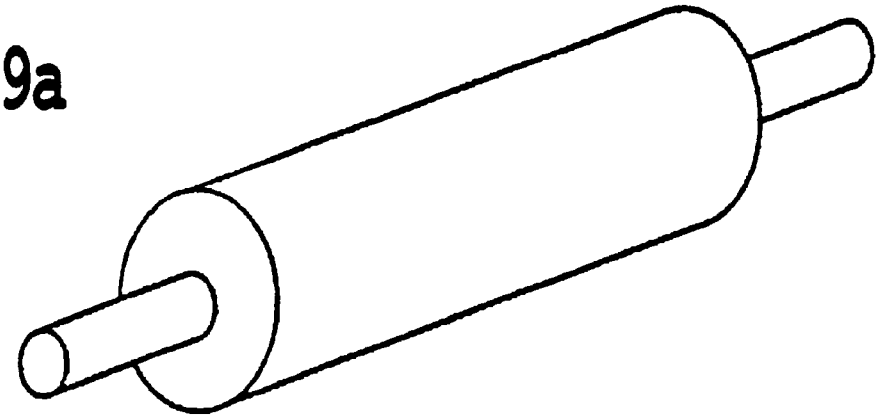
FIGS. 19*a*, 19*b* and 19*c* are perspective views of a plurality of exemplary embodiments for a transfer drum.
Figure 19B:
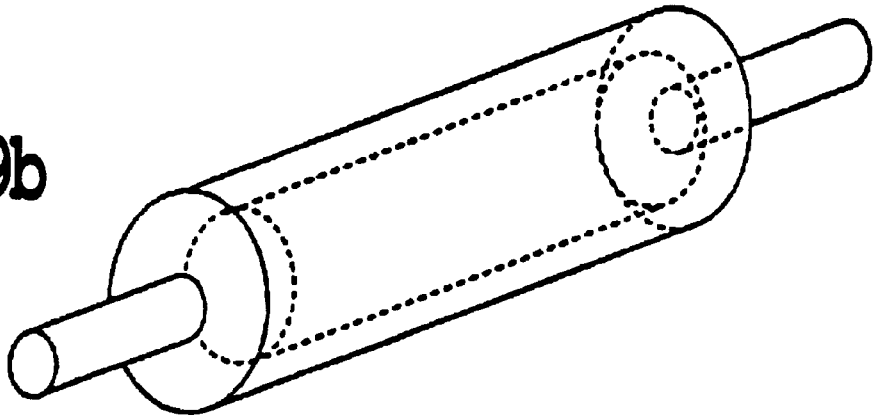
Figure 19C:
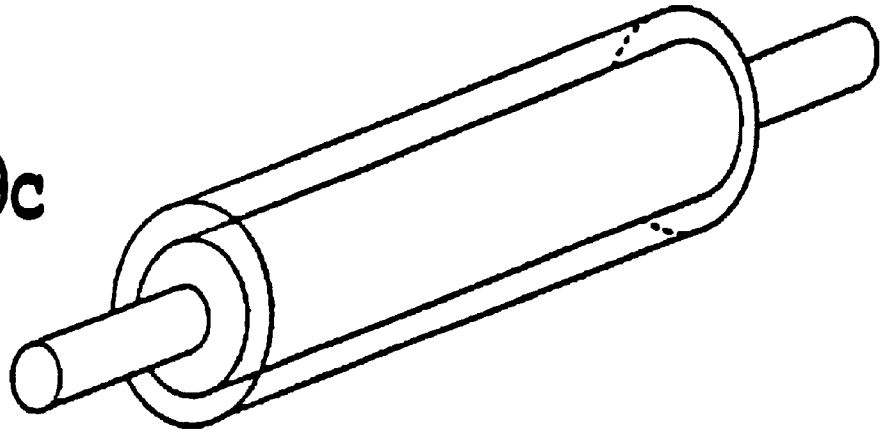

FIGS. 19*a*, 19*b* and 19*c* show various embodiments of the transfer drums. In FIG. 19*a* the transfer drum is cylindrically fashioned and fabricated of an electrically conductive metal, being fabricated as a solid component part. In FIG. 19*b*, the transfer drum is tubularly fabricated of metal, i.e. is hollow on the inside. The FIG. 19*c* shows a metallic core that can be composed of solid material or of a tube. This core is provided with a cladding of high-impedance material. The employment of a metallic core for the transfer drum is expedient since it must be fabricated very precisely with little out-of-roundness. In order to minimize concentricity errors, the circumference of the transfer drum and the length of the transfer band should have a whole-numbered ratio relative to one another. The transfer bands, however, have a certain thickness fluctuation that has a disturbing influence on the transfer printing process; for example, a local detachment of the transfer bands from the drum can occur. Advantageously, an elastic coating is therefore applied onto the transfer drum that can compensate slight mechanical tolerances of the component parts on the basis of elastic deformation. This coating should have an electrical conductivity in order to be able to build up a strong electrical field in the transfer printing zone at its outside skin. The electrical conductivity of the coating should lie in the range from $0.5\times10^{6}$ through $5\times10^{12}$ Ωcm but preferably in the range from $0.5\times10^{5}$ through $5\times10^{9}$ Ωcm. The elastic coating should have a Shore hardness in the range from 10 through 90 Sh(A), preferably lying in the range from 20 through 70 Sh(A). 0.2 through 15 mm, preferably 0.5 through 2 mm are to be set as thickness of the elastic coating. The elastic coating can additionally have a layer of fluorine-containing plastic material, preferably of PFA, ETFE, FEP, PVDC or Teflon or can be composed of a polyimide layer. The additional layer can also be electrically insulating and have a maximum thickness of 40 μm, preferably 0.1 through 20 μm. The elastic layer can have conductive fillers, preferably lampblack, silicates, oxides added to it, this enabling an increased layer thickness.

Figure 20:
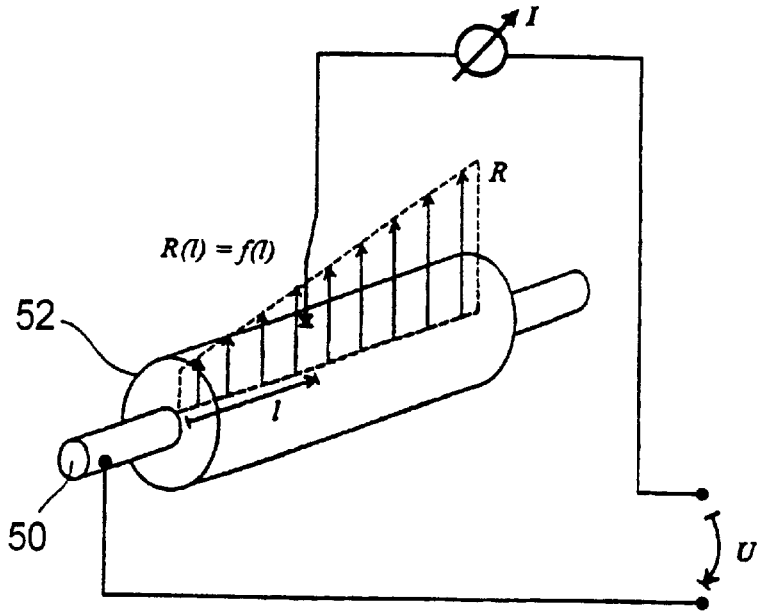
FIG. 20 id s perspective view of a transfer drum composed of high-impedance material having lateral electrode terminals.

FIG. 20 shows a transfer drum that does not have a continuous metallic core but lateral metallic contacting cylinders 50. The middle part 52 of the cylindrical drum is composed of a high-impedance material. The resistance R over the length 1 of the drum is entered in the figure. It can be seen that the resistance R increases with increase length l, as a result whereof the topical currents i drops over the length l when the voltage U is applied. Different potentials thus derive over the length l, this being undesired.

Figure 21:
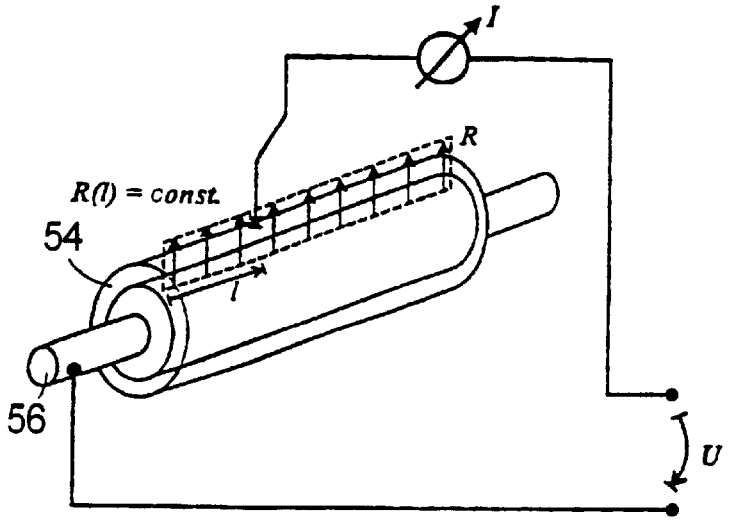
FIG. 21 is a perspective view of a transfer drum having an electrically conductive core in a high-impedance coating.

FIG. 21 shows an exemplary embodiment of a transfer drum having a low-impedance, metallic core 56 on which a coating 54 that is composed of a relatively high-impedance material is applied. The resistance R remains constant over the length l, as a result whereof a constant potential also derives on the surface of the high-impedance jacket coating along the length l. The core can also be manufactured of an electrically conductive plastic, for example of the material PA that contains lampblack particles.

Figures 22A, 22B:
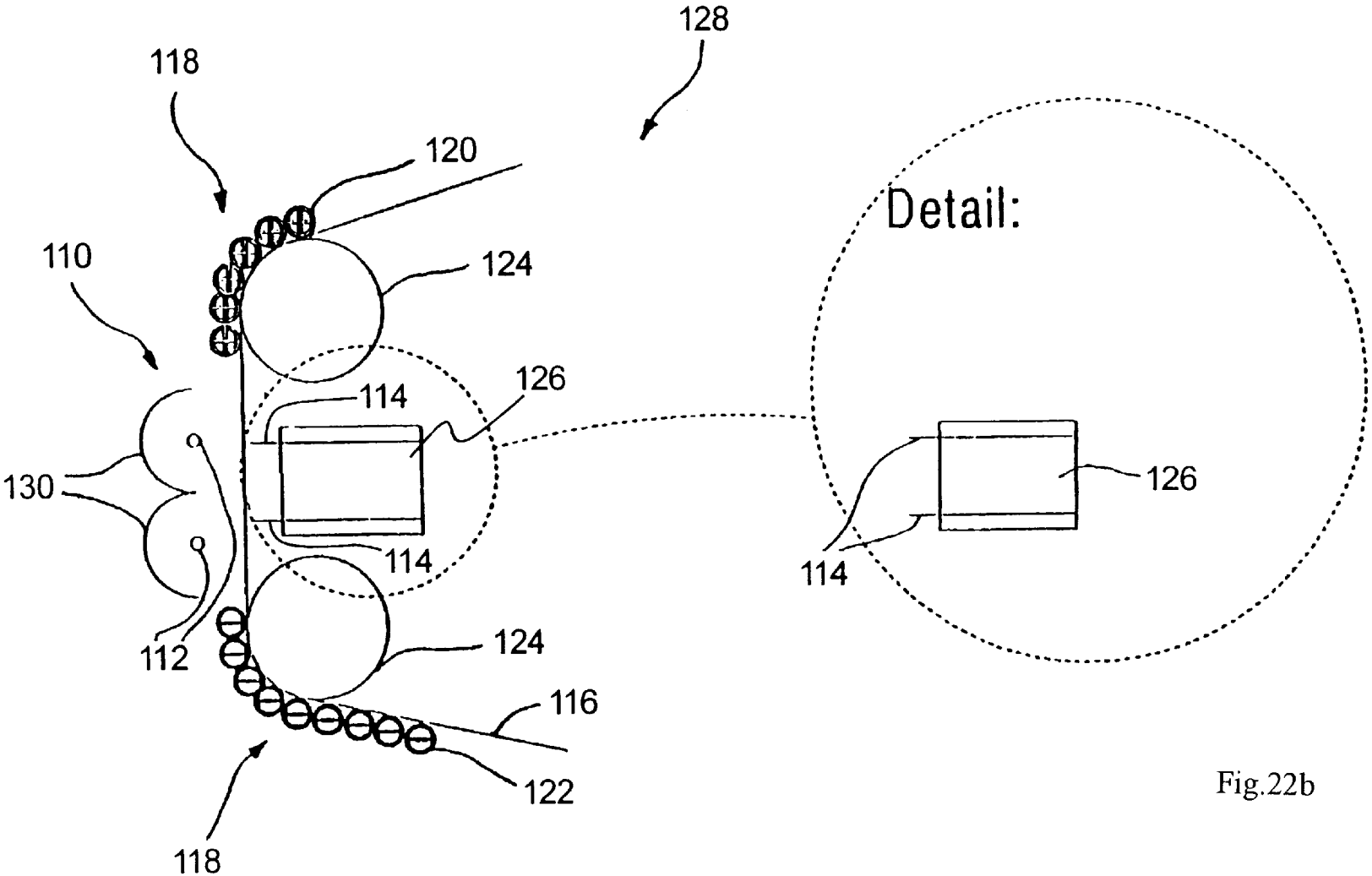
FIG. 22*a* is a side view of a charge reversal corotron device having two corotron wires and two cooperating electrodes fashioned as blades and FIG. 22*b* is an enlarged detail view of the blades.

FIG. 22 shows a charge reversing corotron device 110 having two corotron wires 112 and having two cooperating electrodes 114 fashioned as blades. A photoconductor band 116 is provided as an intermediate carrier. However, a transfer band can also be utilized.

The photoconductive band 116 having a toner image 118 that has not yet been fixed and contains positively charged toner particles 120 or, respectively, negatively charged toner particles 122 after the charge reversal is conducted past between the two corotron wires 112 and the two cooperating electrodes 114, whereby it is guided and driven by deflection rollers 124. The blades 114 are secured to a holder 126 that also produces the electrical connection to the ground potential of the printer and/or copier device 128. The corotron wires 112 are surrounded by two shields 130 at that side facing away from the photoconductive band 116. The photoconductor band 116 is conducted past the cooperating electrodes 114 at a distance in the range from 0.2 mm through 4 mm, preferably in the range from 0.2 mm through 1 mm. The negatively charged toner particles 122 of the latent toner image 118 are reversed in charge due to the electrical field between the corotron wires 112 and the cooperating electrodes 114.

Figure 23:
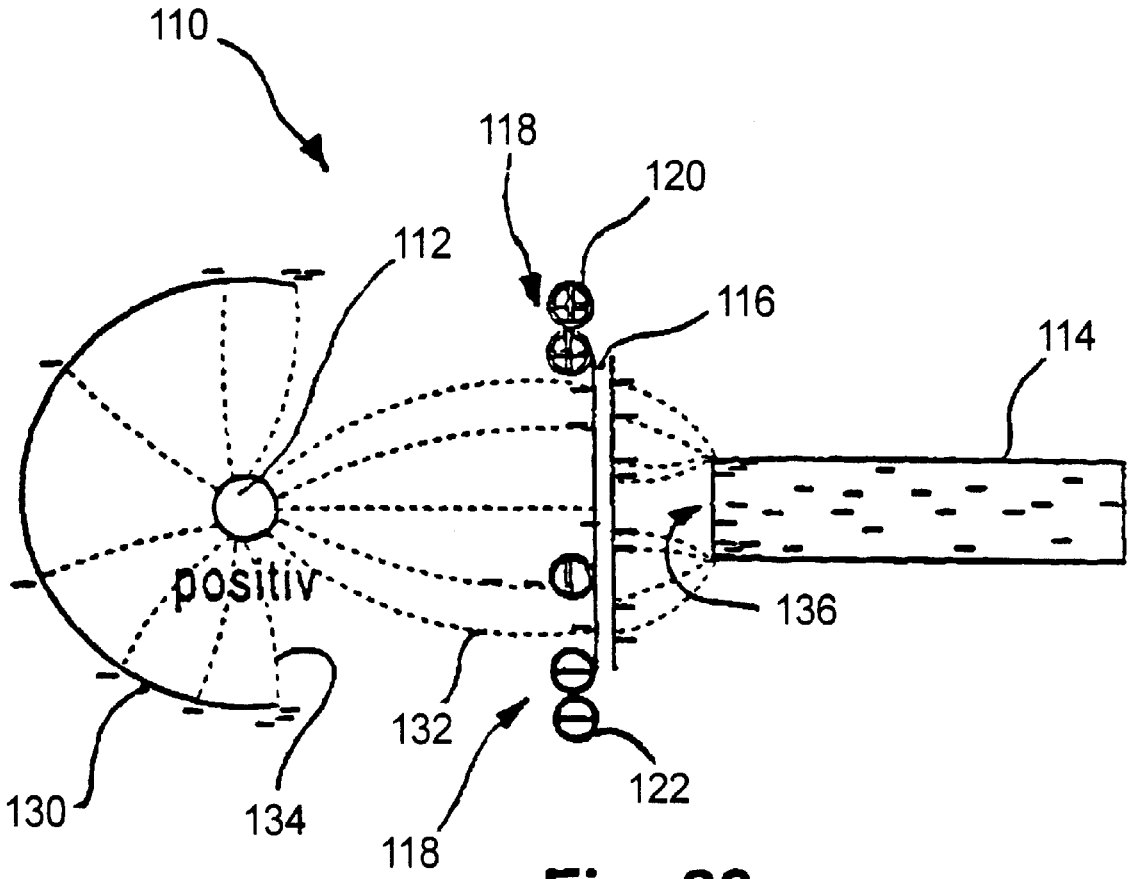
FIG. 23 is a detail view of a charge reversal corotron having a corotron wire and a blade utilized as a cooperating electrode, whereby the field lines of the effective electrical field are indicated.

FIG. 23 shows a charge reversal corotron device 110 with a corotron wire 112 and an individual blade utilized as a cooperating electrode 114, whereby the field lines 132 and 134 of the effective electrical field are indicated. The effective area, on which the amount of the attractive force between photoconductive band 116 and cooperating electrode 114 is dependent, is referenced 136. The cooperating electrode 114 has a connection to a ground electrode. Alternatively, the cooperating electrode can have negative potential with reference to the ground potential. An electrical field is formed between corotron wire 112 and the cooperating electrode 114. This field 134 acts on the toner particles 122, which have a negative potential. The toner particles 122 are discharged when they pass by the corotron wire 112 and are recharged to a positive potential. The amount of the potential of what is now positively charged toner 120 is dependent on the dwell time of the toner in the electrical field and on the density of the electrical field. The photoconductive band 116 is thereby attracted by the cooperating electrode 114. The attractive force F is calculated from the relationship:

$$F = \frac{\varepsilon_0 \cdot \varepsilon_r A \cdot U^2}{2 \cdot d^2},$$

wherein $\in_r$ is the dielectric constant of the air between photoconductive band 116 and the cooperating electrode 114, A is the effective area 136 of the cooperating electrode 114 in the electrical field, U is the difference in potential and d is the distance between the underside of the photoconductive band 116 and the cooperating electrode 114.

FIG. 24 shows another cooperating electrode 114 that is implemented as a blade. This blade 115 has a rectangular cross-section and is secured in the printer and/or copier 128 with a holder 126.

FIG. 25 shows a blade 114 whose cutting edge is serrated. The blade 114 is arranged such in the printer/copier 128 that the serrations 140 taper acutely in the direction of the photoconductive band 116. The serrations 147 are arranged at equal spacings. As a result of this arrangement, a uniform charge reversal of the latent toner image 118 is assured. The holder 126 of the blade 114 is not shown in this FIG. 25.

FIG. 26 shows a cooperating electrode 114 that is composed of an arrangement of individual pins 142. The pins 142 are arranged at symmetrical spacings on a holder 126. The holder 126 is arranged such in the printer and/or copier 128 that the ends of the individual pins 142 lie in a plane that is parallel to the photoconductive band 116 and parallel to the corotron wire 112.

Figure 27:
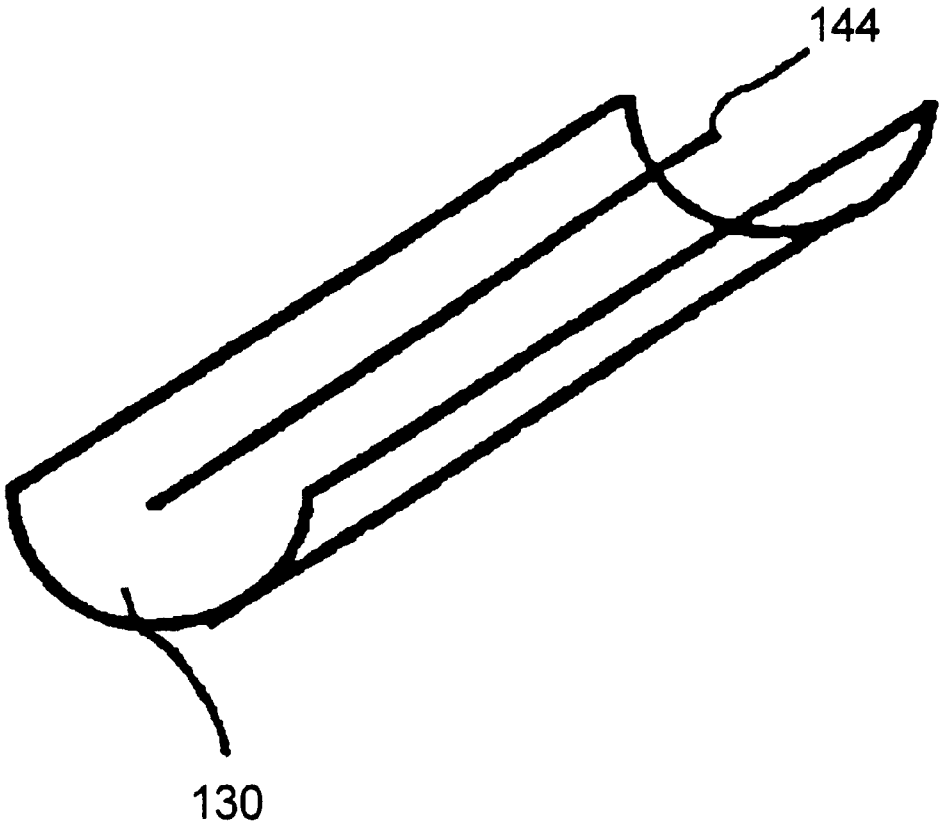
FIG. 27 is a perspective illustration of a cooperating electrode that is composed of a wire.

FIG. 27 shows a cooperating electrode 114 that is composed of a wire 144. The wire 144 is arranged such in the printer and/or copier 128 with a suitable holding mechanism 126 that it lies in a plane that is parallel to the photoconductive band 116 as well as parallel to the corotron wire 112. A shield 130 is arranged at that side of the wire 144 facing away from the photoconductive band 116. A wire 144 similar to the corotron wire 112 is utilized as the wire 144.

Figure 28:
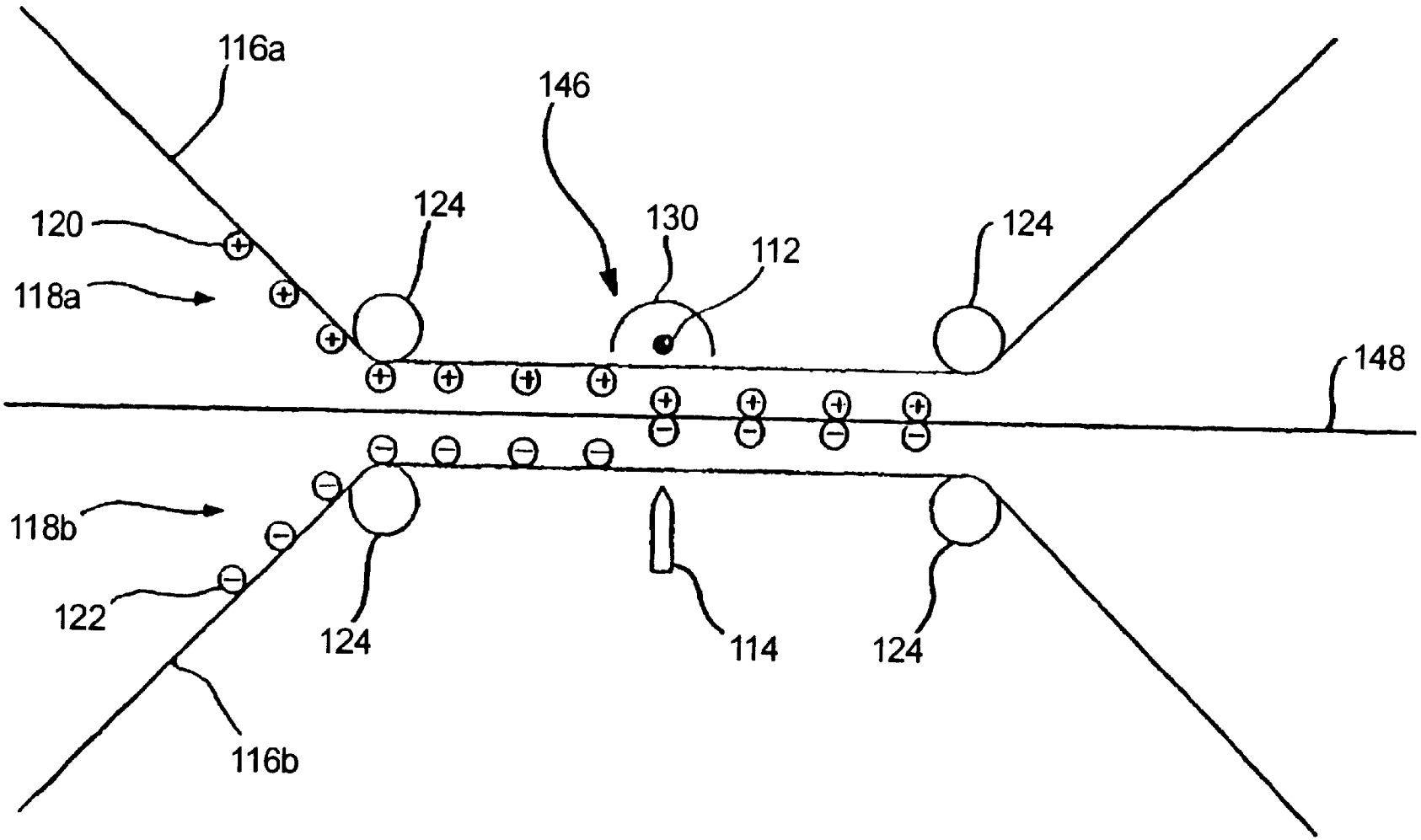
FIG. 28 is a side view of a transfer printing corotron device having a corotron wire and having a cooperating electrode fashioned as a blade.

FIG. 28 shows a transfer printing corotron device 146 having a corotron wire 112 and a cooperating electrode fashioned as a blade 114. Two photoconductive bands **116*a* and 116*b* are provided as the intermediate carrier. Alternatively, however, two transfer bands could also be utilized. A toner image 118*a* on the photoconductive band 116*a* that has not yet been fixed contains positively charged toner particles 120. A toner image 118*b* on the photoconductive band 116 that has not yet been fixed contains negatively charged toner particles 122. The photoconductive bands 116*a* and 116*b* as well as a paper web 148 are conducted past between the corotron wire 112 and the blade 114 without touching these, whereby the photoconductive bands 116*a* and 116*b* are guided and driven by deflection rollers 124. The drive and the guidance of the paper web 148 is not shown in this figure. The corotron wire 122 has a positive potential and the blade 114 has a negative potential with reference to the ground potential. The corotron wire 112 is surrounded by a shield 130 at that side facing away from the photoconductive band 116*a*. The positively charged toner particles 120 of the latent toner image 118***a* are repelled by the positively charged corotron wire 112 and are attracted by the negatively charged toner particles 122 of the latent toner image 118*b* as well as by the negatively charged blade 114. Analogous thereto, the negatively charged toner particles 122 of the latent toner image 118*b* are repelled by the negatively charged blade 114 and are attracted by the positively charged toner particles 120 of the latent toner image 118*a* as well as by the positively charged corotron wire 112. The transfer printing corotron 146 exerts a force on the positively and negatively charged toner particles 120 and 122 that is greater than the bonding forces between the toner particles 120 and 122 and the photoconductive bands 116*a* and 116*b*. The positively and negatively charged toner particles 120 and 122 are transfer printed onto the paper web 146 by the field forces of the electrical field. The toner particles 120 and 122 remain on the paper web 146 due to the binding forces between the toner particles 120 and 122 and the paper web 146 as well as due to the attractive force between the positively charged toner particles 120 on the one paper side and the negatively charged toner particles 122 on the other paper side.

Although other modifications and changes may be suggested by those skilled in the art, it is the intention of the inventors to embody within the patent warranted hereon all changes and modifications as reasonably and properly come within the scope of their contribution to the art.

What is claimed is:

1. A printer or copier, comprising:

a transfer station for simultaneous both-sided printing of a carrier material;

a first transfer module at said transfer station, including:

a first endless transfer band operable to carry toner particles of a first polarity in a region of a transfer printing location;

a second transfer module at said transfer station, including:

a second endless transfer band operable to carry toner particles of a second polarity in the region of the transfer printing location;

apparatus operable to guide the carrier material at the transfer printing location between said first endless transfer band and said second endless transfer band;

an electrostatic field generator at the transfer printing location that effects separation of the toner particles of each transfer band from said respective transfer band as a result of electrostatic forces and causes the toner particles to adhere to a surface of the carrier material lying opposite said respective transfer band;

a switchable transfer printing station in each of said first and second transfer modules, in a first operating mode, said switchable transfer printing station initially keeps said respective transfer band at a distance from the carrier material so that a plurality of toner images are arranged on top of one another on said respective transfer band and the carrier material does not move forward at the transfer printing location and then conducts said respective transfer band close to the carrier material in order to transfer the toner images arranged on top of one another onto the carrier material in common, and in a second operating mode, said switchable transfer printing station conducts said respective transfer band close to the carrier material in order to continuously print monochromatic toner images onto the carrier printer.

2. A printer or copier as claimed in claim 1, wherein said first operating mode is a collecting and printing mode, and said second operating mode is a continuous printing mode.

3. A printer or copier according to claim 1, wherein said first and second endless transfer bands, as viewed in a delivery direction of the carrier material, have toner images with toner particles of a same polarity in a section preceding said transfer printing location; and further comprising:

a charge reversing Korotron arranged along one of said first and second endless transfer bands preceding said transfer printing location, said charge reversing Korotron operable to generate an electrical field that reverses polarity of the toner particles on said one of said first and second endless transfer bands by charge reversal.

4. A printer or copier according to claim 3, wherein the toner particles in a section preceding said charge reversing Korotron are of a positive polarity.

5. A printer or copier according to claim 3, wherein the toner particles in a section preceding said charge reversing Korotron are of a negative polarity.

6. A printer or copier according to claim 1, further comprising:

two transfer drums disposed opposite one another at the transfer printing location; and a DC voltage source applied to said two transfer drums to generate an electrical field for transfer printing of the toner particles.

7. A printer or copier according to claim 6, wherein one of said two transfer drums carries ground potential.

8. A printer or copier according to claim 6, wherein said two transfer drums have a symmetrical potential to ground.

9. A printer or copier as claimed in claim 6, wherein said two transfer drums have an asymmetrical potential to ground.

10. A printer or copier according to claim 6, wherein said two transfer drums are arranged such that the carrier material wraps said two transfer drums by a predetermined wrap angle.

11. A printer or copier according to claim 6, further comprising:

two guide elements are arranged preceding said two transfer drums as viewed in a delivery direction of the carrier material, said first and second endless transfer bands and the carrier material being guided between said two guide elements.

12. A printer or copier according to claim 11, further comprising:

an electrical connection to a first of said two transfer drums and a first of said two guide elements lying diagonally opposite it to generate an electrical field between said first transfer drum and said first guide element for transfer printing of the toner particles.

13. A printer or copier according to claim 12, wherein a second of said two transfer drums and a second of said two guide elements are at a floating potential.

14. A printer or copier according to claim 12, wherein said two guide elements are rollers.

15. A printer or copier according to claim 12, wherein said two guide elements are rigid deflection bows whose sliding surfaces are arranged close to the transfer drums.

16. A printer or copier according to claim 12, further comprising:

two delivery elements disposed preceding said two guide elements as viewed in the delivery direction of the carrier material, the transfer bands and the carrier material being guided between said delivery elements.

17. A printer or copier according to claim 16, wherein said two delivery elements have ground potential.

18. A printer or copier according to claim 6, wherein said two transfer drums have a metallic core and an elastic coating having a predetermined electrical conductivity on said metallic core.

19. A printer or copier according to claim 18, wherein said predetermined electrical conductivity of said elastic coating lies in a range from $0.5\times10^{-6}$ through $5\times10^{12}$ Ωcm.

20. A printer or copier as claimed in claim 19, wherein said range is from $0.5\times10^{5}$ through $5\times10^{9}$ Ωcm.

21. A printer or copier according to claim 18, wherein said elastic coating has a Shore hardness in a range from 10 through 90 Sh(A).

22. A printer or copier as claimed in claim 21, wherein said elastic coating has a Shore hardness range from 20 through 70 Sh(A).

23. A printer or copier according to claim 18, wherein said elastic coating has a thickness from 0.2 through 15 mm.

24. A printer or copier as claimed in claim 23, wherein said elastic coating has a thickness from 0.5 through 2 mm.

25. A printer or copier according to claim 18, wherein said elastic coating includes an additional coating of fluorine-containing plastic material.

26. A printer or copier as claimed in claim 25, wherein said additional coating is of a material selected from the list consisting of: PFA, ETFE, FEP, PVDC, Teflon and polyimide.

27. A printer or copier according claim 25, wherein said additional layer is electrically insulating and has a maximum thickness of 40 μM.

28. A printer or copier as claimed in claim 27, wherein said additional layer is of a thickness of from 0.1 through 20 μm.

29. A printer or copier according to claim 25, wherein said additional coating has a conductive filler added to it.

30. A printer or copier as claimed in claim 29, wherein said conductive filler of said additional coating is one of lampblack, silicates, and oxides.

31. A printer or copier according to claim 18, wherein said elastic coating has conductive filler added to it.

32. A printer or copier as claimed in claim 31, wherein said conductive filler is selected from lampblack, silicates, and oxides.

33. A printer or copier according to claim 1, wherein the carrier material is a band material.

34. A printer or copier as claimed in claim 33, wherein said band materials is one of a paper web and single sheets.

35. A printer or copier according to claim 1, wherein each transfer module contains a corotron device.

* * * * *